US008342815B2

(12) United States Patent
Watanabe et al.

(10) Patent No.: US 8,342,815 B2
(45) Date of Patent: Jan. 1, 2013

(54) OIL PUMP

(75) Inventors: Yasushi Watanabe, Aiko-gun (JP); Koji Saga, Ebina (JP)

(73) Assignee: Hitachi, Ltd., Tokyo (JP)

( * ) Notice: Subject to any disclaimer, the term of this patent is extended or adjusted under 35 U.S.C. 154(b) by 668 days.

(21) Appl. No.: 12/365,661

(22) Filed: Feb. 4, 2009

(65) Prior Publication Data

US 2009/0196772 A1 Aug. 6, 2009

(30) Foreign Application Priority Data

Feb. 5, 2008 (JP) ..... 2008-024638

(51) Int. Cl.
*F04B 49/08* (2006.01)

(52) U.S. Cl. ..... 417/213; 417/220; 417/302

(58) Field of Classification Search ..... 417/213, 417/220, 279, 302, 410.3, 442, 502, 506, 417/559, 443, 289, 293; 418/88, 166, 171
See application file for complete search history.

(56) References Cited

U.S. PATENT DOCUMENTS 5,547,349 A 8/1996 Kimura et al.
6,460,510 B1 * 10/2002 Breeden ..... 123/446
2006/0222527 A1 10/2006 Kurita et al.
2007/0231177 A1 * 10/2007 Yamaguchi et al. ..... 418/166
2008/0210500 A1 * 9/2008 Walker ..... 188/151 R

FOREIGN PATENT DOCUMENTS

JP 4-237898 A 8/1992
JP 6-25581 U 4/1994
JP 8-114186 A 5/1996
JP 2001-123967 A 5/2001
JP 2006-233867 A 9/2006

OTHER PUBLICATIONS

Japanese Office Action dated Jan. 17, 2012 (five (5) pages).

* cited by examiner

*Primary Examiner* — Anh Mai
*Assistant Examiner* — Fatima Farokhrooz
(74) *Attorney, Agent, or Firm* — Crowell & Moring LLP

(57) ABSTRACT

Fluid inlet and outlet portions are provided for introducing and discharging a hydraulic fluid. The fluid outlet portion includes a plurality of outlet ports. A drive shaft is provided that rotates about its axis. A plurality of volume variable pump chambers are arranged about the drive shaft and rotated by the same. The pump chambers are arranged between the fluid inlet and outlet portions for compressing the hydraulic fluid from the fluid inlet portion before discharging the same from the fluid outlet portion. The pump chambers are exposed to the outlet ports separately one after another when the pump chambers are rotated by the drive shaft. A discharge rate varying mechanism is provided that varies a fluid discharge rate of each of the outlet ports by varying the amount of the fluid led to the outlet ports.

15 Claims, 18 Drawing Sheets

| REQUIREMENT / OPERATION CONDITION | CONSTANT PRESSURE CIRCUIT | | HIGH PRESSURE CIRCUIT | |
|---|---|---|---|---|
| | NEEDED HYDRAULIC PRESSURE | NEEDED FLOW RATE | NEEDED HYDRAULIC PRESSURE | NEEDED FLOW RATE |
| LOW SPEED OPERATION OF ENGINE | P1 | Q1 | P2 | Q3 |
| NORMAL SPEED OPERATION OF ENGINE | P1 | Q2 | P2 | Q3 |
| UNDER OPERATION OF ACTUATORS (NORMAL SPEED OPERATION OF ENGINE) | P1 | Q2 | P3 | Q4 |

$P3 > P1 \geqq P2$
$Q4 > Q2 > Q1 \geqq Q3$

OIL PUMP

BACKGROUND OF THE INVENTION

Field of the Invention

The present invention relates in general to oil pumps applicable to automotive engines and automotive transmissions, and more particularly to the oil pumps of a type that not only feeds elements of the engine (or transmission) with a less pressurized oil to lubricate and cool the same but also feeds hydraulically operated actuating devices of the engine (or transmission) with a highly pressurized oil to drive the same.

That is, for example, in case wherein two hydraulic circuits are provided which separately need of introducing hydraulic fluids that are different in pressure (or introducing rate), usage of two oil pumps may be easily thought out. However, in this case, high-cost and complicated construction of the hydraulic system is inevitably induced due to usage of the two oil pumps.

In view of such drawback, various measures have been hitherto proposed and put into practical use in the field of the hydraulic system. One of them is an oil pump as disclosed in Japanese Laid-open Application (tokkaihei) 8-114186, which is provided with two (or more) outlet ports that separately discharge hydraulic fluids that are different in pressure (or fluid discharge rate).

The oil pump of the publication is a so-called internal trochoid pump that comprises mutually meshed toothed outer and inner rotors each having trochoidal tooth profile. That is, the toothed outer and inner rotors are meshed to each other keeping a mutual eccentricity therebetween, so that under operation a plurality of volume variable pump chambers are continuously formed between the internal teeth of the outer rotor and the external teeth of the inner rotor.

An operating chamber of a pump housing that accommodates the two rotors is formed at a bottom portion thereof with an inlet port that is exposed to a volume increasing zone in which each pump chamber is shifted from the smallest volume position to the largest volume position along a given way defined by the two rotors. While, to a volume reducing zone in which each pump chamber is shifted from the largest volume position to the smallest volume position, there are exposed two independent outlet ports (viz., first and second outlet ports) having a seal land portion located at a predetermined circumferential position.

Under operation, the hydraulic fluid in each pump chamber shifted from the largest volume position to the seal land portion is led (or discharged) to the first outlet port and the hydraulic fluid in the pump chamber shifted from the seal land portion to the smallest volume position is led (or discharged) to the second outlet port. Accordingly, the first and second outlet ports can discharge two types of hydraulic fluid separately in accordance with the circumferential position of the seal land portion.

SUMMARY OF THE INVENTION

In case wherein the oil pump is employed in a motor vehicle, the first outlet port of the oil pump is connected to a first hydraulic circuit to discharge a hydraulic pressure for lubricating and cooling various elements of the engine (or transmission) and the second outlet port of the oil pump is connected to a second hydraulic circuit to discharge a hydraulic pressure for driving hydraulically operated actuating devices.

In this case, the followings are important.

That is, in the first hydraulic circuit, feeding a pressure stable hydraulic fluid is constantly needed, and in the second hydraulic circuit, feeding a high pressure fluid is needed only when the hydraulically operated actuating devices are actually operated.

However, in the above-mentioned known oil pump, the fluid discharge rate is substantially proportional to the rotation speed of the oil pump. Thus, when the second hydraulic circuit connected to the second outlet port of the oil pump needs a fluid introducing rate that is higher than that needed by the first hydraulic circuit connected to the first outlet port, it is inevitably necessary to increase the rotation speed of the oil pump with the aid of an electric motor or the like.

However, under such condition, the hydraulic pressure or fluid discharge rate of the hydraulic fluid discharged from the first outlet port is wastefully increased, which brings about a useless work of the oil pump even though the work of the oil pump satisfies the fluid feeding to the second hydraulic circuit. Even when the seal land portion is set at an optimum position for minimizing the wasteful work of the oil pump, energization of the electric motor for increasing the rotation speed of the oil pump brings about useless consumption of electric power.

Accordingly, an object of the present invention is to provide an oil pump which is free of the above-mentioned drawbacks.

According to the present invention, there is provided an oil pump that is constructed to reduce a wasteful pumping work as small as possible.

According to the present invention, there is provided an oil pump that comprises a fluid outlet portion that includes a plurality of outlet ports and a discharge rate varying mechanism that varies the fluid discharge rate of each of the outlet ports, so that the fluid discharging ratio between the outlet ports is also varied.

In accordance with a first aspect of the present invention, there is provided an oil pump which comprises a fluid inlet portion for introducing a hydraulic fluid; a fluid outlet portion for discharging the hydraulic fluid, the fluid outlet portion including a plurality of outlet ports; a drive shaft that rotates about an axis thereof; a plurality of volume variable pump chambers arranged about the drive shaft and rotated by the same, the pump chambers being arranged between the fluid inlet portion and the fluid outlet portion for compressing the hydraulic fluid from the fluid inlet portion before discharging the same from the fluid outlet portion, the pump chambers being exposed to the outlet ports separately one after another when the pump chambers are rotated by the drive shaft; and a discharge rate varying mechanism that varies a fluid discharge rate of each of the outlet ports by varying the amount of the fluid led to the outlet ports.

In accordance with a second aspect of the present invention, there is provided an oil pump which comprises a fluid inlet portion for introducing a hydraulic fluid; a fluid outlet portion for discharging the hydraulic fluid, the fluid outlet portion including a plurality of outlet ports; a drive shaft that rotates about an axis thereof; a plurality of volume variable pump chambers arranged about the drive shaft and rotated by the same, the pump chambers being arranged between the fluid inlet portion and the fluid outlet portion for compressing the hydraulic fluid from the fluid inlet portion before discharging the same from the fluid outlet portion, the pump chambers being exposed to the outlet ports separately one after another when the pump chambers are rotated by the drive shaft, each outlet port extending in a circumferential direction around the axis of the drive shaft; and a discharge rate varying mechanism that varies an actual open range of each of the outlet ports relative to the pump chambers thereby to vary a fluid discharge rate of each outlet port.

In accordance with a third aspect of the present invention, there is provided an oil pump which comprises an inner rotor rotated by a drive shaft; an outer rotor rotatably disposed around the inner rotor keeping an eccentricity relative to the inner rotor; a plurality of volume variable pump chambers defined between the inner and outer rotors when the inner and outer rotors make a relative rotation; a fluid inlet portion exposed to a circumferential range that induces increase in volume of each pump chamber when the inner and outer rotors make the relative rotation; a fluid outlet portion exposed to a circumferential range that induces decrease in volume of each pump chamber when the inner and outer rotors make the relative rotation; and a discharge rate varying mechanism that varies a degree of the eccentricity of the outer rotor relative to the inner rotor.

BRIEF DESCRIPTION OF THE DRAWINGS

Other objects and advantages of the present invention will become apparent from the following description when taken in conjunction with the accompanying drawings, in which.

DETAILED DESCRIPTION OF THE EMBODIMENTS

In the following, three embodiments 100, 200 and 300 of the present invention and one modification 100' of the embodiment 100 will be described in detail with reference to the accompanying drawings.

For ease and simplification, substantially same elements, parts and portions are designated by the same numerals throughout the description and drawings, and repeated explanation on the same elements, parts and portions will be omitted in the following description.

As will become apparent as the description proceeds, in the embodiments 100, 200 and 300 and the modification 100', the oil pump of the invention will be described as a hydraulic pressure supplier that supplies both an automotive engine (viz., internal combustion engine) and an associated transmission with respective hydraulic pressures.

Referring to FIGS. 1 to 10, there is shown an oil pump 100 which is a first embodiment of the present invention.

Figure 7:
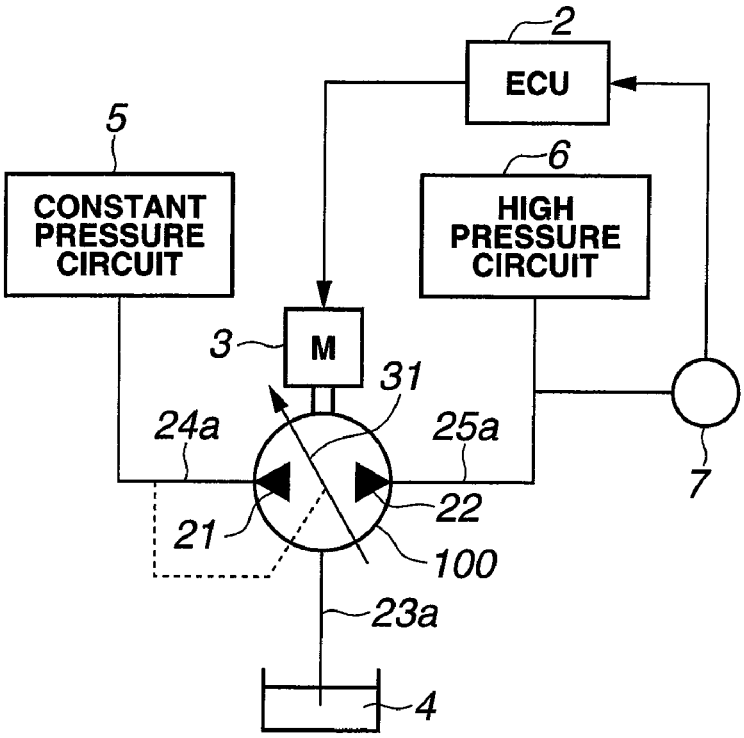
FIG. 7 is a hydraulic circuit to which the oil pump of the first embodiment is practically applied.

As is understood from FIG. 7, the oil pump 100 is arranged to be driven by an electric motor 3 and feeds both a constant pressure circuit 5 and a high pressure circuit 6 with respective pressurized hydraulic pressures. As will be described in detain hereinafter, constant pressure circuit 5 is connected to a first outlet port 21 of the pump 100 and high pressure circuit 6 is connected to a second outlet port 22 of the pump 100.

Electric motor 3 is controlled by an electronic control unit (ECU) 2. Under operation, oil pump 100 sucks a drained hydraulic fluid from an oil pan 4 through a pipe 23*a* and discharges compressed hydraulic fluid to both constant pressure circuit 5 and high pressure circuit 6 through respective pipes 24*a* and 25*a*, as shown.

Designated by numeral 7 in FIG. 7 is a pressure sensor that senses a hydraulic pressure appearing in pipe 25*a* and feeds electronic control unit (ECU) 2 with a corresponding information on the sensed hydraulic pressure.

Constant pressure circuit 5 is the circuit to provide various elements of the engine and transmission with hydraulic fluid for lubricating and cooling the same. Such elements are, for example, a crankshaft, camshaft, pistons and the like of the engine and rotation shafts and gear drive members of the transmission.

High pressure circuit 6 is the circuit to provide hydraulically operated actuating devices with hydraulic fluid (viz., hydraulic pressure) to drive the actuating devices. Such devices are, for example, actuators of a variable valve timing mechanism of the engine and actuators of hydraulic clutches and hydraulic brakes of the transmission.

As is seen in FIG. 7, high pressure circuit 6 is connected to pressure sensor 7 that monitors the pressure of the hydraulic fluid fed from oil pump 100 to high pressure circuit 6. Based on the pressure information signal from pressure sensor 7, electronic control unit 2 controls electric motor 3.

Figure 5:
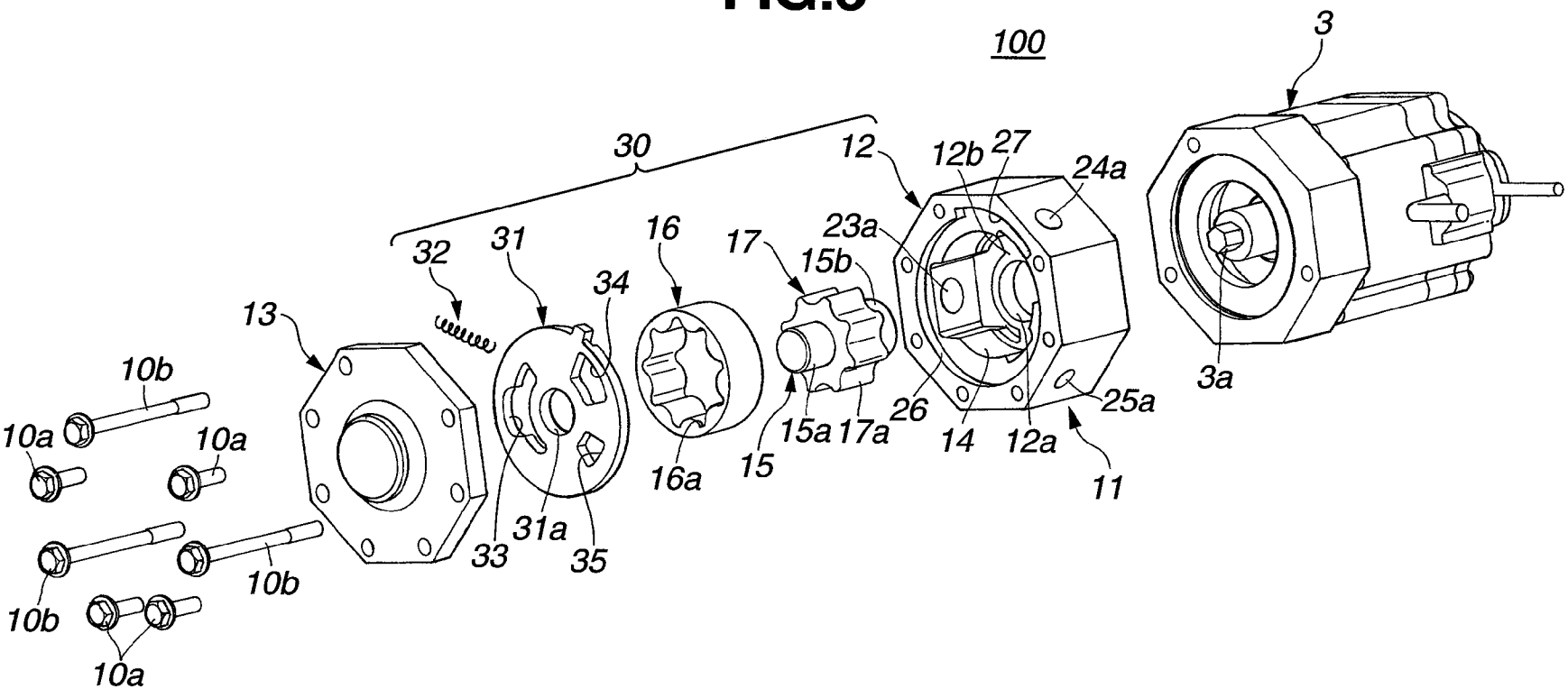
FIG. 5 is an exploded perspective view of the oil pump of the first embodiment.
Figure 6:
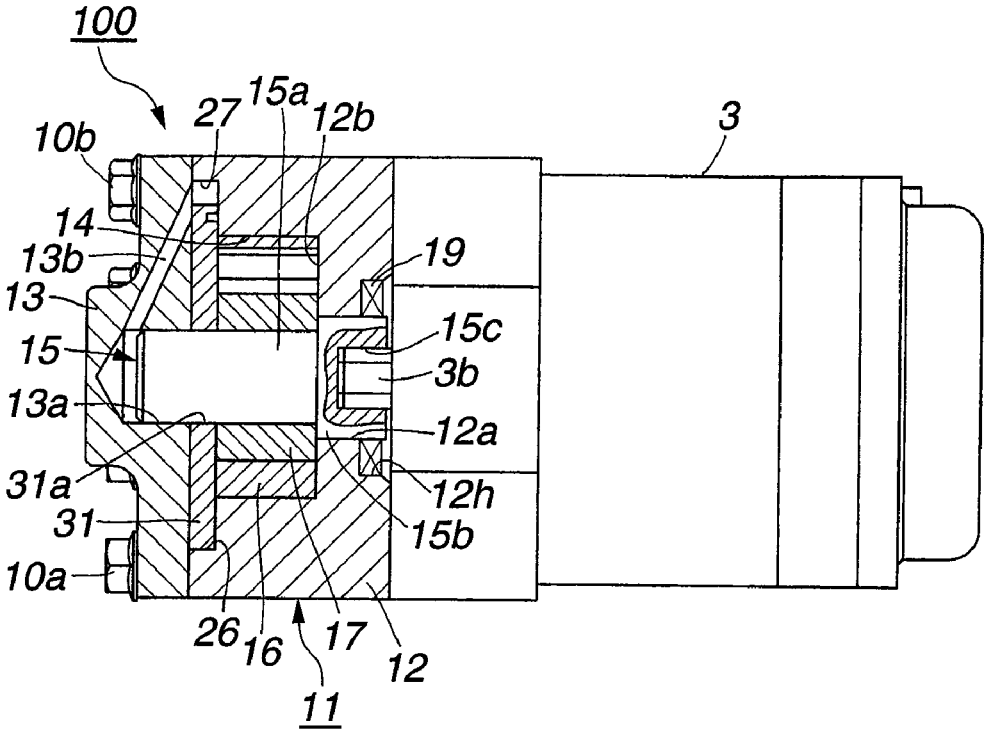
FIG. 6 is a partially sectioned side view of a unit including the oil pump of the first embodiment and an electric motor, showing the oil pump in a sectional manner.

As is seen from FIGS. 5 and 6, oil pump 100 is integrated with electric motor 3 to constitute a unit. That is, oil pump 100 and electric motor 3 are coupled together in a so-called face-to-face connecting manner. That is, as is seen from FIG. 5, upon coupling, an output shaft 3*a* of electric motor 3 projects into oil pump 100.

As is best seen from FIG. 5, oil pump 100 comprises a pump housing 11 that has a generally cylindrical rotor receiving bore 14, a drive shaft 15 that is rotatably installed in rotor receiving bore 14 and connected at one end (viz., right end in the drawing) to output shaft 3*a* of electric motor 3, an annular outer rotor 16 that is rotatably received in rotor receiving bore 14, an inner rotor 17 that is tightly disposed on drive shaft 15 and rotatably received in the annular outer rotor 16, and a discharge rate varying mechanism 30 that is arranged at a side of pump housing 11 opposite to electric motor 3.

As will be apparent hereinafter, discharge rate varying mechanism 30 functions to vary the rate of fluid discharge (which will be referred to "fluid discharge rate" hereinafter) of oil pump 100 to each of the above-mentioned constant pressure circuit 5 and high pressure circuit 6.

As is seen from FIGS. 5 and 6, pump housing 11 comprises a pump body 12 that has one end portion formed with the rotor receiving bore 14 and the other end portion fixed to electric motor 3, and a cover member 13 that is connected to the open side of pump body 12 to cover rotor receiving bore 14. For this connection, four connecting bolts 10*a* are used and as is best seen from FIG. 5, three elongate connecting bolts 10*b* are used for connecting cover member 13, pump body 12 and electric motor 3 together.

Figure 2:
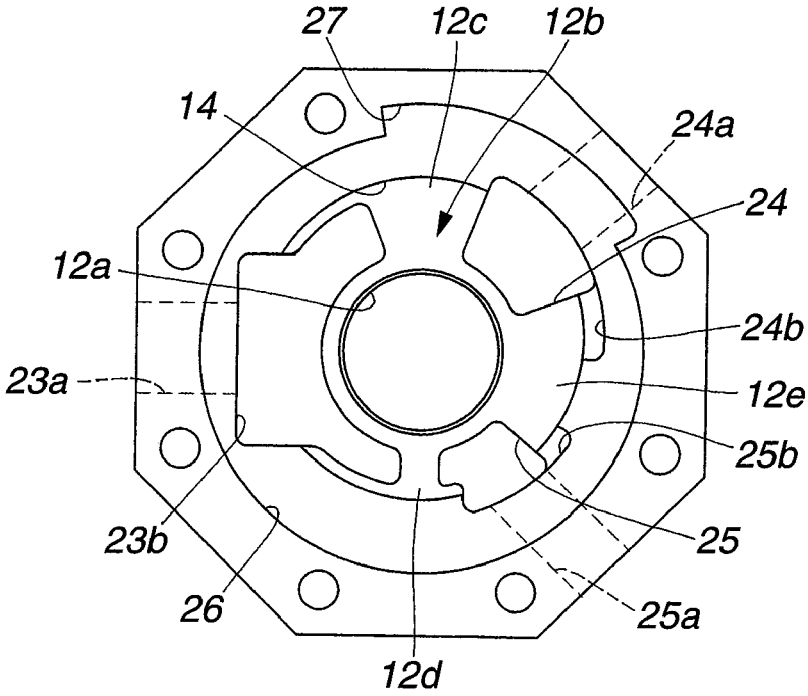
FIG. 2 is a view similar to FIG. 1, but showing a condition in which various pump elements and a discharge rate varying mechanism are removed.

As is seen from FIGS. 2 and 5, pump body 12 made of an aluminum alloy is cylindrical with an octagonal external appearance.

As is seen from FIG. 5, pump body 12 has in an end wall thereof a bearing bore 12*a* that bears or rotatably receives an after-mentioned larger diameter part 15*b* of drive shaft 15.

It is to be noted that cylindrical rotor receiving bore 14 is somewhat eccentric with respect to bearing bore 12*a*. In other words, the center axis of the cylindrical bore 14 is eccentric to an axis that passes through a center of bearing bore 12*a*.

As is understood from FIG. 6, the cylindrical wall of bearing bore 12*a* is formed with an annular groove 12*h* for receiving therein a seal member 19. With this seal member 19, undesired leakage of the hydraulic fluid from the cylindrical bore 14 toward electric motor 3 is suppressed.

As is seen from FIG. 6, cover member 13 fixed to the open side of pump body 12 is formed at a center part with a bearing blind bore 13*a* into which an end of an after-mentioned smaller diameter part 15*a* of drive shaft 15 is rotatably received. That is, bearing blind bore 13*a* concentrically faces the above-mentioned bearing bore 12*a*.

Furthermore, cover member 13 is formed with a drain passage 13*b* that communicates bearing blind bore 13*a* with an after-mentioned back pressure chamber 36*a*, so that the hydraulic fluid that has been led into bearing blind bore 13*a* from rotor receiving bore 14 through a clearance defined around smaller diameter part 15*a* of drive shaft 15 is led to the back pressure chamber 36*a*.

Drive shaft 15 is a stepped shaft including the smaller diameter part 15*a* that is press-fitted into a center opening (no numeral) of inner rotor 17 and the larger diameter part 15*b* that is detachably connected to output shaft 3*a* of electric motor 3.

For the detachable connection of larger diameter part 15*b* with output shaft 3*a*, as will be understood from FIG. 6, the larger diameter part 15*b* is formed with a hexagonal blind bore 15*c* with which a hexagonal top 3*b* of output shaft 3*a* is intimately engaged to achieve a coupling therebetween. That is, upon energization of electric motor 3, output shaft 3*a* drives drive shaft like a single unit.

Figure 1:
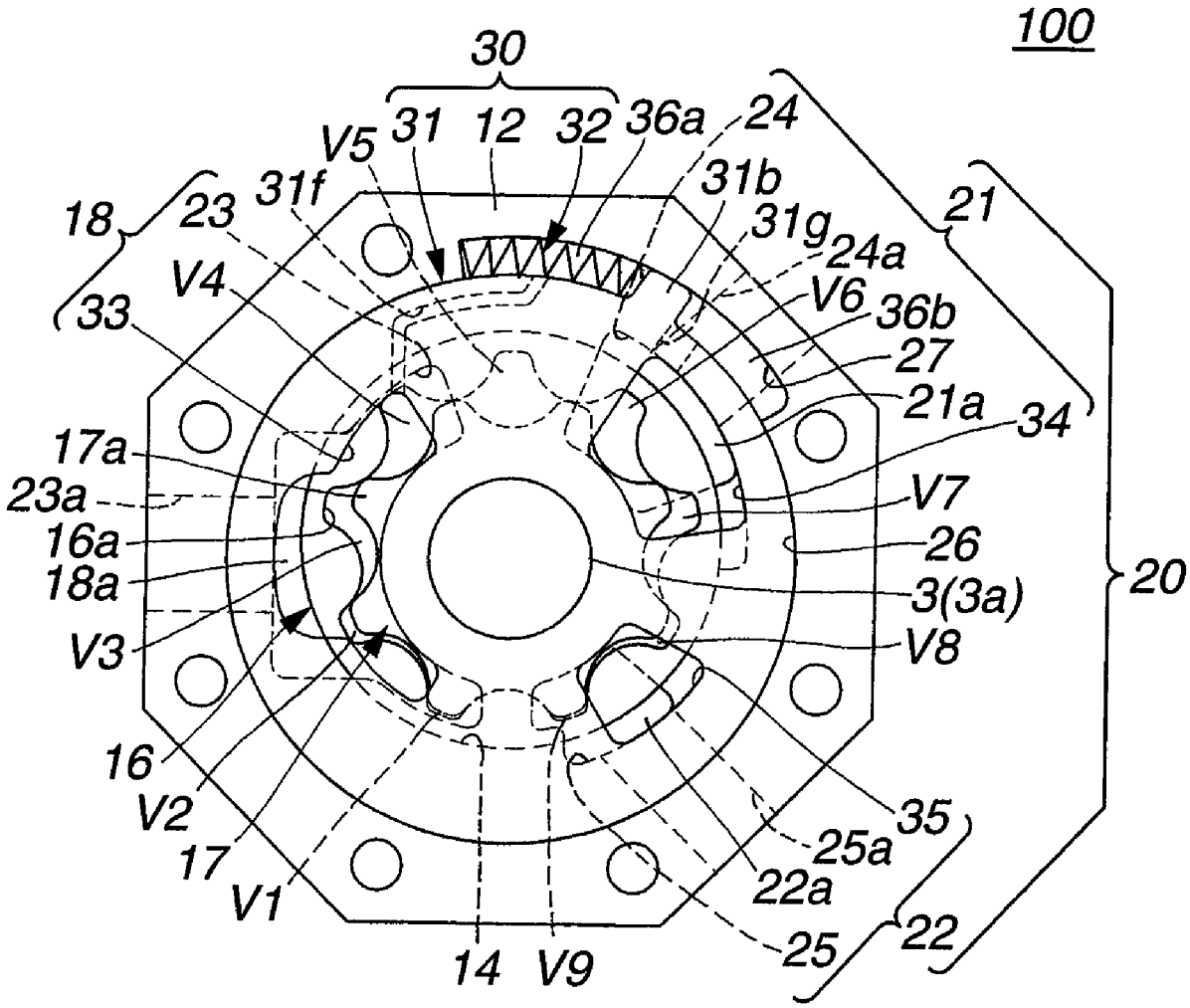
FIG. 1 is a front view of an oil pump of a first embodiment of the present invention with a cover member removed, showing a mating surface of a pump body.
Figure 3:
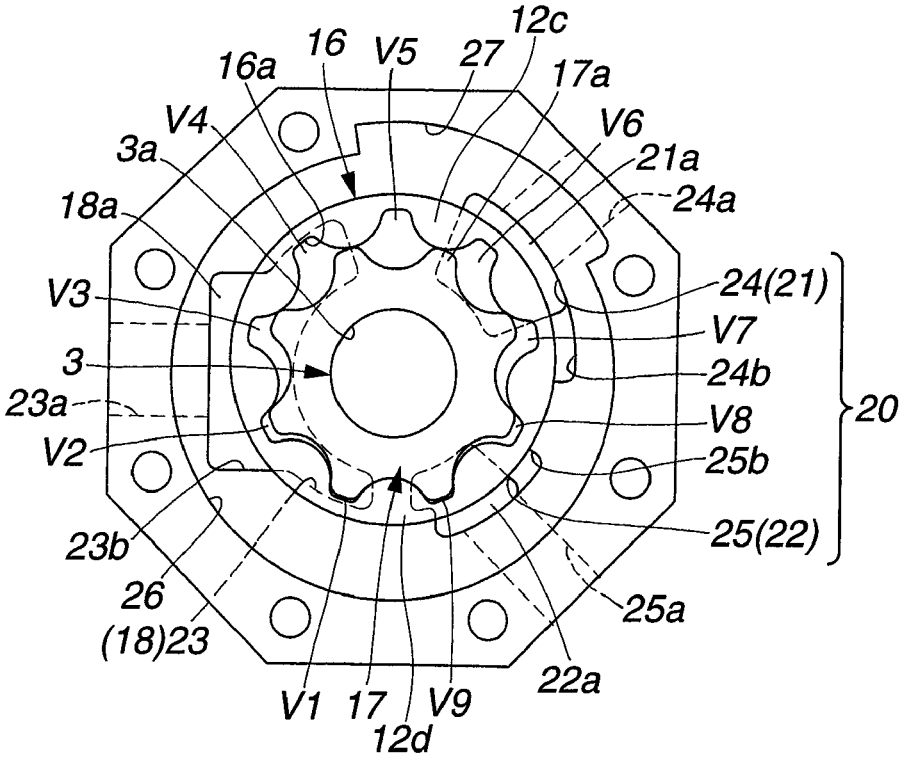
FIG. 3 is a view similar to FIG. 1, but showing a condition in which the discharge rate varying mechanism is removed.

As is seen from FIGS. 1, 3 and 5, outer rotor 16 is rotatably received in rotor receiving bore 14 permitting a cylindrical outer surface thereof to slide on and along a cylindrical inner surface of the bore 14.

Outer rotor 16 is formed with a plurality of internal teeth 16*a* each having a trochoidal profile.

Inner rotor 17 is formed with a plurality of external teeth 17*a* each having a trochoidal profile. Upon coupling between inner and outer rotors 17 and 16, the external teeth 17*a* of inner rotor 17 are operatively engaged with the internal teeth 16*a* of outer rotor 16.

It is to be noted that the number of the external teeth 17*a* is less than that of the internal teeth 16*a* by one. In the illustrated embodiment 100, the number of the external teeth 17*a* is eight, and that of the internal teeth 16*a* is nine.

As is seen from FIG. 3, upon assembly, inner rotor 17 is operatively received in outer rotor 16 keeping an eccentric arrangement therebetween. That is, under operation, some of external teeth 17*a* of inner rotor 17 are practically engaged with some of internal teeth 16*a* of outer rotor 16.

As will become apparent as the description proceeds, upon rotation of inner rotor 17, outer rotor 16 is forced to make a rotation relative to inner rotor 17 keeping the mutually eccentric arrangement.

As is seen from FIG. 3, under the relative rotation therebetween, inner and outer teeth 16*a* and 17*a* are forced to contact continuously thereby continuously defining a plurality of pump chambers V1 to V9 therebetween, each pump chamber gradually increasing or decreasing.

Under operation of oil pump 100, the four pump chambers V1 to V4 placed in a volume increasing range (viz., left half portion in FIG. 3) that brings about a gradual increase of the volume in response to rotation of the two rotors 16 and 17 are forced to suck the hydraulic fluid from oil pan 4 through an inlet port 18 due to the work of negative pressure produced in the pump chambers V1 to V4 in response to increase of the volume of the same.

The inlet port 18 is arranged to straddle over the four pump chambers V1 to V4 and thus has a generally U-shaped cross section.

While, under operation of oil pump 100, the other five pump chambers V5 to V9 placed in a volume decreasing range (viz., right half portion in FIG. 3) that brings about a gradual decrease of the volume in response to rotation of the two rotors 16 and 17 are forced to discharge the hydraulic fluid therefrom to the outside through an outlet port 20 due to the work of positive pressure produced in the pump chambers V5 to V9 in response to decrease of the volume of the same.

Like the inlet port 18, the outlet port 20 is arranged to straddle over the five pump chambers V5 to V9 and has a generally U-shaped cross section.

As is understood from FIG. 1, outlet port 20 comprises first and second outlet ports 21 and 22 that are isolated from each other.

That is, first outlet port 21 is exposed to pump chambers V6 and V7 that are placed at a leading portion of the above-mentioned volume decreasing range and thus show relatively large volume, and second outlet port 22 is exposed to pump chambers V8 and V9 that are placed at a trailing portion of the volume decreasing range and thus show relatively small volume.

In pump chambers V6 to V9, reduction in volume gradually takes place and thus each pump chamber discharge the compressed hydraulic fluid to first and second outlet ports 21 and 22.

As is seen from FIG. 2, on an inner surface of the other wall of pump body 12, there is defined a rotor sliding surface 12*b* to which one axial end surface of each rotor 16 or 17 slidably contacts under rotation of the rotor.

As is seen from FIGS. 1 and 2, rotor sliding surface 12*b* is formed with a fixed inlet port 23 in a circumferential range corresponding to the above-mentioned volume increasing range, that is exposed to pump chambers V1 to V4 of intake side. Fixed inlet port 23 constitutes one side portion of the above-mentioned inlet port 18.

Furthermore, rotor sliding surface 12*b* is formed with an arcuate first fixed outlet port 24 in a range corresponding to a leading portion of the above-mentioned volume decreasing range, that is exposed to pump chambers V6 and V7 of discharge side. First fixed outlet port 24 constitutes one side portion of the above-mentioned first outlet port 21. Furthermore, rotor sliding surface 12*b* is formed with an arcuate second fixed outlet port 25 in a range corresponding to a trailing portion of the volume decreasing range, that is exposed to pump chambers V8 and V9 of discharge side. Second fixed outlet port 25 constitutes one side portion of the above-mentioned second outlet port 22.

As is seen from FIG. 3, fixed inlet port 23 is formed at a circumferential middle portion thereof with an inlet opening 23*a* that extends radially outward. Although not shown in the drawings, inlet opening 23*a* is connected to the above-mentioned oil pan 4 through a pipe. That is, under operation, the hydraulic fluid is sucked into fixed inlet port 23 from oil pan 4 through inlet opening 23*a*.

Furthermore, as is well seen from FIG. 3, fixed inlet port 23 is formed at the circumferential middle portion thereof with a recess 23*b* that is depressed radially outward. Due to provision of recess 23*b*, there is formed an inlet port communicating is passage 18*a* that extends around outer rotor 16 to communicate fixed inlet port 23 with an after-mentioned movable inlet port 33.

While, the above-mentioned arcuate first fixed outlet port 24 is formed at a circumferential middle portion thereof with a first outlet opening 24*a* that extends radially outward. Although not shown in the drawings, through a pipe connected to first outlet opening 24*a*, the hydraulic fluid compressed by pump chambers V6 and V7 is led to the above-mentioned constant pressure circuit 5.

Furthermore, first fixed outlet port 24 is so shaped as to extend radially outward beyond outer rotor 16, that is, beyond the inside surface of rotor receiving bore 14, and first fixed outlet port 24 has an extension part 24*b* that extends in a direction of rotation of the two rotors 16 and 17. For convenience sake, the extension part 24*b* will be called first communication auxiliary groove 24*b* hereinafter. Due to provision of first communication auxiliary groove 24*b*, there is provided a first outlet port communicating passage 21*a* that extends around outer rotor 16 to communicate first fixed outlet port 24 with an after-mentioned first movable outlet port 34. Actually, first outlet port communicating passage 21*a* comprises a peripheral part of first fixed outlet port 24 and first communication auxiliary groove 24*b*.

Like the above, the above-mentioned arcuate second fixed outlet port 25 is formed at a radially outside part thereof with a second outlet opening 25*a*. Although not shown in the drawings, through a pipe connected to second outlet opening 25*a*, the hydraulic fluid compressed by pump chambers V8 and V9 is led to the above-mentioned high pressure circuit 6.

Second fixed outlet port 25 is further formed at another radially outside part thereof with a second communication auxiliary groove 25*b* that extends in the direction of rotation of the two rotors 16 and 17. Due to provision of second communication auxiliary groove 25*b*, there is provided a second outlet port communicating passage 22*a* that extends around outer rotor 16 to communicate second fixed outlet port 25 with an after-mentioned second movable outlet port 35. Actually, second outlet port communicating passage 22*a* comprises a peripheral part of first fixed outlet port 24 and second communication auxiliary groove 25*b*.

As is seen from FIG. 2, between fixed inlet port 23 and fixed outlet port 24, there is arranged a first fixed side seal land 12*c* that constitutes part of the above-mentioned rotor sliding surface 12*b*, and between fixed inlet port 23 and second fixed outlet port 25, there is arranged a second fixed side seal land 12*d* that constitutes part of the rotor sliding surface 12*b*.

As will be seen from FIGS. 2 and 3, first fixed side seal land 12*c* has a circumferential length that is generally the same as the pitch of the external teeth 17*a* of inner rotor 17. That is, as is understood from FIG. 3, first fixed side seal land 12*c* is so arranged and sized as to completely cover pump chamber V5 that exhibits the maximum volume when leaving the volume increasing range and entering the volume decreasing range.

While, as is seen from FIG. 2, second fixed side seal land 12*d* has a circumferential length that is generally the same as the distance between adjacent two bottoms of the internal teeth 16*a* of outer rotor 16. As is understood from FIG. 3, second fixed side seal land 12*d* is so arranged and sized not to cover two pump chambers V1 and V9 at a time when pump chamber V1 shows the minimum volume in the volume increasing range and pump chamber V9 shows the maximum volume in the volume decreasing range.

As is seen from FIG. 2, between arcuate first fixed outlet port 24 and arcuate second fixed outlet port 25, there are arranged first and second fixed side seal lands 12*c* and 12*d* and a third fixed side seal land 12*e* that constitutes the above-mentioned rotor sliding surface 12*b*. Third fixed side seal land 12*e* serves to divide outlet port 20, as shown.

It is now to be noted that by changing a circumferential position of third fixed side seal land 12*e*, respective circumferential ranges of first and second outlet ports 21 and 22 are changed and thus the fluid discharge rate of oil pump 100 relative to each of the two ports 21 and 22 is changed.

As is seen from FIGS. 1 and 3, pump body 12 is formed is formed at the open end wall thereof with a generally cylindrical recess 26 for receiving an after-mentioned rotary plate 31. Cylindrical recess 26 is concentric with the above-mentioned bearing bore 12*a*, and rotary plate 31 constitutes part of the discharge rate varying mechanism 30.

As is seen from FIGS. 2 and 6, cylindrical recess 26 has an outer diameter sufficiently larger than that of rotor receiving bore 14, so that there is defined therebetween a plate seat portion on and around which rotary plate 31 moves.

Under a condition wherein the two rotors 16 and 17 are properly set in rotor receiving bore 14, axially outer surfaces of the rotors 16 and 17 are flush with a seating surface of rotary plate 31.

As is best seen from FIG. 2, cylindrical recess 26 is formed at a cylindrical wall thereof with an arcuate groove 27 that is depressed in radially outward. As is seen from the drawing, arcuate groove 27 is concentric with cylindrical recess 26.

As may be understood from FIG. 1, discharge rate varying mechanism 30 is of a mechanism including two major parts that make a relative rotation therebetween. More specifically, discharge rate varying mechanism 30 comprises pump housing 11 that constitutes one of the major parts, rotary plate 31 that is slidably received in cylindrical recess 26 to rotate by an angular range corresponding to the circumferential length of cylindrical recess 26 thereby defining inlet port 18 and first and second outlet ports 21 and 22, and a spring 32 that is received in one end portion of arcuate groove 27 to bias rotary plate 31 in a given direction, that is, in a clockwise direction in FIG. 1. As will be described in the following, for being biased by the spring 32, rotary plate 31 is formed with a lever portion 31*b*.

As is understood from FIG. 6, rotary plate 31 has a thickness that is substantially the same as the depth of the plate receiving recess (or cylindrical recess) 26, and rotary plate 31 is circular in shape. Under rotation of rotary plate 31, one surface slides on cover member 13 and the other surface slides on the outside surfaces of the two rotors 16 and 17. Rotary plate 31 is formed with a shaft receiving opening 31*a* through which smaller diameter part 15*a* of drive shaft 15 passes. Thus, rotary plate 31 is permitted to make a relative rotation to drive shaft 15.

As is seen from FIG. 1, rotary plate 31 is formed at a peripheral part with the above-mentioned lever portion 31*b* that, under rotation of rotary plate 31, slidably contacts an outer cylindrical surface of arcuate groove 27 to divide the interior of the groove 27 into two chambers. With such arrangement, under a condition wherein rotary plate 31 is set in plate receiving recess 26 having cover member 13 hermetically connected thereto, the arcuate groove 27 forms therein a back pressure chamber 36*a* that is placed at a position opposite to the rotation direction of the two rotors 16 and 17 to receive therein the spring 32, and a pressure chamber 36*b* that is placed at the rotational direction of the rotors 16 and 17 to introduce the discharge pressure from first outlet port 21.

Although not shown in the drawings, cover member 13 is formed with stopper pins to which lever portion 31*b* of rotary plate 31 abuts for regulating the rotating range of rotary plate 31.

As is seen from FIGS. 1 and 5, rotary plate 31 is formed with movable inlet port 33 and first and second movable outlet ports 34 and 35 that constitute counter-portions of the above-mentioned inlet port 18 and first and second outlet ports 21 and 22.

Movable inlet port 33 and first and second movable outlet ports 34 and 35 are sized to correspond to fixed inlet port 23 and fixed first and second fixed outlet ports 24 and 25 that are formed in rotor sliding surface 12*b* of pump body 12.

Figure 8:
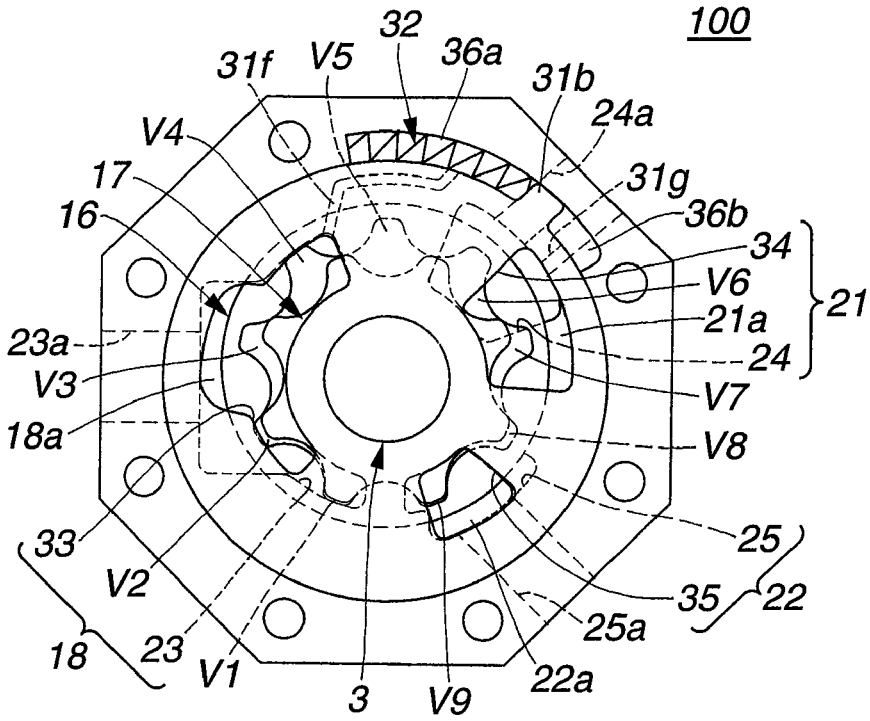
FIG. 8 is a view similar to FIG. 1, but showing a condition in which a discharging pressure of a first outlet port is lower than a predetermined value (viz., initial condition of the oil pump)
Figure 9:
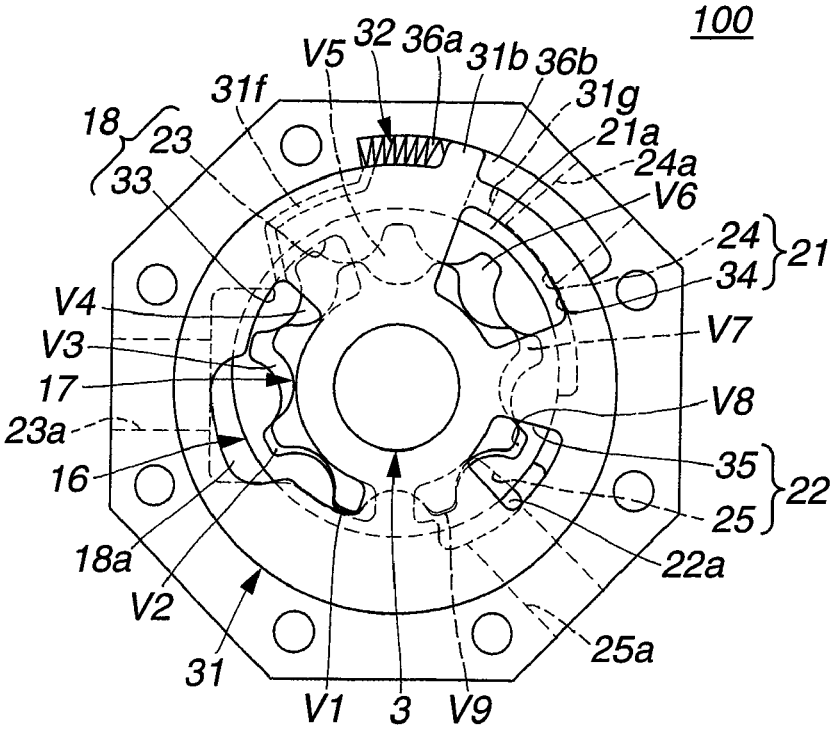
FIG. 9 is a view similar to FIG. 1, but showing a condition in which the discharging pressure of the first outlet port shows a maximum value.

More specifically, as is seen from FIGS. 1, 8 and 9, movable inlet port 33 has a shape similar to that of fixed inlet port 23. However, a circumferential length of movable inlet port 33 is shorter than that of fixed inlet port 23. Thus, throughout the entire rotation range of rotary plate 31, movable inlet port 33 is permitted to overlap with fixed inlet port 23.

Figure 4:
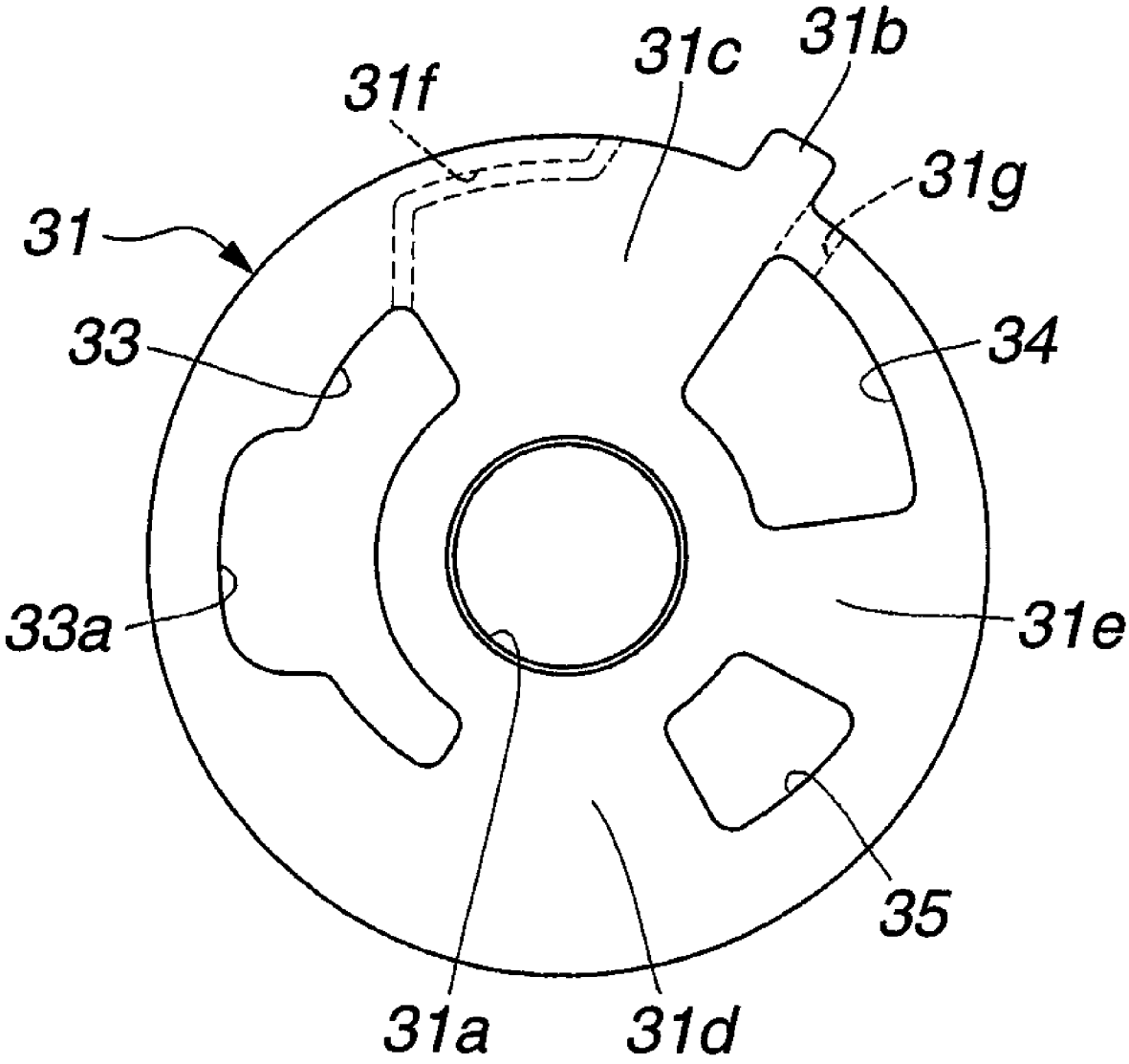
FIG. 4 is a front view of a rotary plate employed in the oil pump of the first embodiment of the present invention.

As is seen from FIG. 4, like the above-mentioned fixed inlet port 23, movable inlet port 33 of rotary plate 31 is formed at a circumferentially middle part thereof with a radially outwardly depressed recess 33*a*. At the position where recess 33*a* overlaps with recess 23*b* of fixed inlet port 23, there is defined the above-mentioned inlet port communicating passage 18*a*.

With the above-mentioned arrangement, part of the hydraulic fluid led into fixed inlet port 23 through the above-mentioned inlet opening 23*a* is led into movable inlet port 33 through inlet port communicating passage 18*a*, so that also from movable inlet port 33, the hydraulic fluid is led into pump chambers V1 to V4.

First movable outlet port 34 has a shape identical to first fixed outlet port 24, and in a radial direction, throughout the entire rotating range of rotary plate 31, first movable outlet port 34 is exposed to first fixed outlet port 24, and as is seen from FIG. 9, in a circumferential direction, when rotary plate 31 takes the counterclockwise-most position, the port 34 fully overlaps with first fixed outlet port 24.

Thus, as is seen from FIG. 1, at a radially outward side of outer rotor 16 where first movable outlet port 34 overlaps with first fixed outlet port 24, there is defined the above-mentioned first outlet port communicating passage 21*a*. The hydraulic fluid discharged to first movable outlet port 34 through the communicating passage 21*a* is discharged from first outlet port 24*a* together with the hydraulic fluid discharged to first fixed outlet port 24.

Second movable outlet port 35 has a shape similar to the above-mentioned second fixed outlet port 25. However, a circumferential length of the port 35 is somewhat shorter than that of second fixed outlet port 25, and in a radial direction, throughout the entire rotating range of rotary plate 31, the outlet port 35 is fully mated with second fixed outlet port 25, and as is seen from FIG. 8, in a circumferential direction, when rotary plate 31 is rotated to the clockwise-most position, the outlet port 35 is fully mated with second fixed outlet port 25.

As is seen from FIG. 1, like the above-mentioned first movable outlet port 34, second movable outlet port 35 is formed, around outer rotor 16 at a position where second movable outlet port 35 and first fixed outlet port 25 are mated, with the above-mentioned second outlet port communicating passage 22*a*, so that the hydraulic fluid discharged to second movable outlet port 35 through the communicating passage 22*a* is discharged from a second outlet port 25*a* together with the hydraulic fluid discharged to second fixed outlet port 25.

As is described hereinabove, movable ports 33 to 35 are arranged to constitute respective passage units together with communicating passages 18*a*, 21*a* and 22*a* and fixed outlet ports 23, 24 and 25. More specifically, movable port 33 and fixed inlet port 23 constitute the inlet port 18, first movable outlet port 34 and first fixed outlet port 24 constitute the first outlet port 21 and second movable outlet port 35 and second fixed outlet port 25 constitute second outlet port 22.

As will be understood from the above description, the movable ports 33 to 35 are arranged eccentric to the corresponding fixed ports 23 to 25. This is because of the followings. That is, a first movable side seal land 31*c* of rotary plate 31 between movable inlet port 33 and first movable outlet port 34 and a second movable side seal land 31*d* of rotary plate 31 between movable inlet port 33 and second movable outlet port 35 have circumferential lengths that are greater than those of the corresponding first and second fixed side seal lands 12*c* and 12*d*, and a third movable side seal land 31*c* of rotary plate 31 between first movable outlet port 34 and second movable outlet port 35 has a circumferential length that is smaller than that of third fixed side seal land 12*e* and generally equal to the pitch of the external teeth 17*a* of inner rotor 17.

Due to the above-mentioned arrangement, throughout the entire rotation range of rotary plate 31, first and second movable side seal lands 31*c* and 31*d* can overlap with the corresponding first and second fixed side seal lands 12*c* and 12*d*, and thus, under operation, the first and second fixed side seal lands 12*c* and 12*d* serve as an actual seal land means.

While, third movable side seal land 31*e* has a circumferential length that is smaller than that of third fixed side seal land 12*e*, and throughout the entire rotation range of rotary plate 31, third fixed side seal land 12*e* can constantly overlap with third movable side seal land 31*e*, and thus, under operation, third movable side seal land 31*e* serves as an actual seal land means.

That is, since the third seal land portion that separates first and second outlet ports 21 and 22 moves in a circumferential direction upon rotation of rotary plate 31, the ranges of first and second outlet ports 21 and 22 are subjected to a change, and as a result, the fluid discharge rate of oil pump 100 relative to each of the two outlet ports 21 and 22 is changed.

As is seen from FIGS. 1 and 4, rotary plate 31 is formed on an outer side surface (viz., the surface opposite to the surface to which end surfaces of two rotors 16 and 17 slidably contact) with a pressure relief groove 31*f* that constantly connects one end (near first movable side seal land 31*c*) of movable inlet port 33 and the above-mentioned back pressure chamber 36*a*. That is, due to presence of such groove 31*f*, movable inlet port 33 and back pressure chamber 36*a* keeps their mutual fluid communication even under rotation of rotary plate 31. More specifically, due to presence of such pressure relief groove 31*f*, the hydraulic fluid led to the back pressure chamber 36*a* can be returned to movable inlet port 33.

As is seen from FIG. 1, within back pressure chamber 36*a*, there is installed the above-mentioned spring 32 for constantly biasing rotary plate 31 to rotate in the same direction as the rotation of the two rotors 16 and 17.

While, as is seen from FIGS. 1 and 4, on the outer side surface of rotary plate 31, there is further formed a pressure induction groove 31*g* that constantly connects one end (viz., the end near first movable side seal land 31*c*) of first movable outlet port 34 and the above-mentioned pressure chamber 36*b*. That is, even under rotation, the fluid communication between the port 34 and the chamber 36*b* is assuredly kept. Due to presence of such groove 31*g*, the discharge pressure of first outlet port 21 is led to the pressure chamber 36*b* to press lever portion 31*b* of rotary plate 31 thereby to bias rotary plate 31 to rotate in a direction opposite to the direction in which the two rotors 16 and 17 rotate. That is, in FIG. 1, rotary plate 31 is biased to rotate in a counterclockwise direction.

As will be understood from the above description, in the discharge rate varying mechanism 30, rotary plate 31 rotates in accordance with a difference between the discharge pressure at first outlet port 21 and the biasing force of spring 32 thereby changing the circumferential position of third movable side seal land 31*e*. With this, a circumferential open range of first outlet port 21 relative to pump chambers V6 and V7 and that of second outlet port 22 relative to pump chambers V6 and V7 are changed, so that the fluid discharge rate to each of first and second outlet ports 21 and 22 is changed.

In the following, with reference to the drawings, especially, FIGS. 1, 8 and 9, operation of oil pump 100 of the present invention will be described with respect to operation of the discharge rate varying mechanism 30.

FIG. 8 shows a condition wherein oil pump 100 is about to start its pumping work. Under this condition, due to the biasing force of spring 32, rotary plate 31 is biased in a clockwise direction in the drawing and takes the clockwise-most position. That is, FIG. 8 shows a condition wherein rotary plate 31 assumes the clockwise-most position in the rotating range. Due to provision of the stopper pins (not shown) provided by cover member 13, excessive clockwise rotation of rotary plate 31 is suppressed.

When rotary plate 31 assumes the position as shown in FIG. 8, first outlet port 21 shows such a state that first fixed outlet port 24 and first movable outlet port 34 are most displaced away from each other maximizing the open range exposed to pump chambers V6 and V7. In this condition, the hydraulic fluid from first outlet port 21 shows the maximum fluid discharge rate. While, when rotary plate 31 assumes the position of FIG. 8, second outlet port 22 shows such a state that second fixed outlet port 25 and second movable outlet port 35 fully overlap with each other minimizing the open range exposed to pump chambers V8 and V9. In this condition, the hydraulic fluid from second outlet port 22 shows the minimum fluid discharge rate.

In response to increase of rotation speed of oil pump 100, the discharge pressure appearing at first discharge port 21 increases. When the discharge pressure exceeds a predetermined value (viz., set pressure), rotary plate 31 is forced to rotate counterclockwise to a position, such as the position as shown in FIG. 1, against the biasing force of spring 32.

In such position, third fixed side seal land 12*e* assumes a circumferential middle position relative to third movable side seal land 31*e* showing a small circumferential distance between first fixed outlet port 24 and first movable outlet port 34 as compared with the case shown in FIG. 8 and producing a certain circumferential distance between second fixed outlet port 25 and second movable outlet port 35. That is, in accordance with a counterclockwise rotation of rotary plate 31 in FIG. 1, the fluid discharge rate of first outlet port 21 is gradually reduced and that of second outlet port 22 is gradually increased.

When thereafter the discharge pressure in first discharge port 21 is further increased, rotary plate 31 is further rotated counterclockwise in the drawing due to the force of the increased discharge force, and finally, rotary plate 31 is rotated to the position as shown in FIG. 9.

When rotary plate 31 is at the position of FIG. 9, first outlet port 21 takes such a condition that first fixed outlet port 24 and first movable outlet port 34 are fully mated with each other, so that the open range exposed to pump chambers V6 and V7 is minimized and thus the fluid discharge rate of first outlet port 21 is minimized. While, when rotary plate 31 is at the position of FIG. 9, second outlet port 22 takes such a condition that second fixed outlet port 25 and second movable outlet port 35 are maximally placed away from each other in a circumferential direction, so that the open range exposed to pump chambers V8 and V9 is maximized and thus the fluid discharge rate of second outlet port 22 is maximized.

As is described hereinabove, rotary plate 31 is continuously rotated in accordance with the discharge pressure of first outlet port 21 applied to the right side (in FIGS. 8 and 9) of lever portion 31*b* of rotary plate 31. When the discharge pressure of first outlet port 21 is lowered, rotary plate 31 is rotated clockwise in the drawings due to the force of spring 32 thereby increasing the fluid discharge rate of first outlet port 21.

In the discharge rate varying mechanism 30, by rotating rotary plate 31 in accordance with the discharge pressure at first outlet port 21, the fluid discharge rate of first or second outlet port 21 or 22 is increased or decreased for keeping the discharge pressure of first outlet port 21 at a predetermined degree (viz., set pressure).

Figures 10, 11:
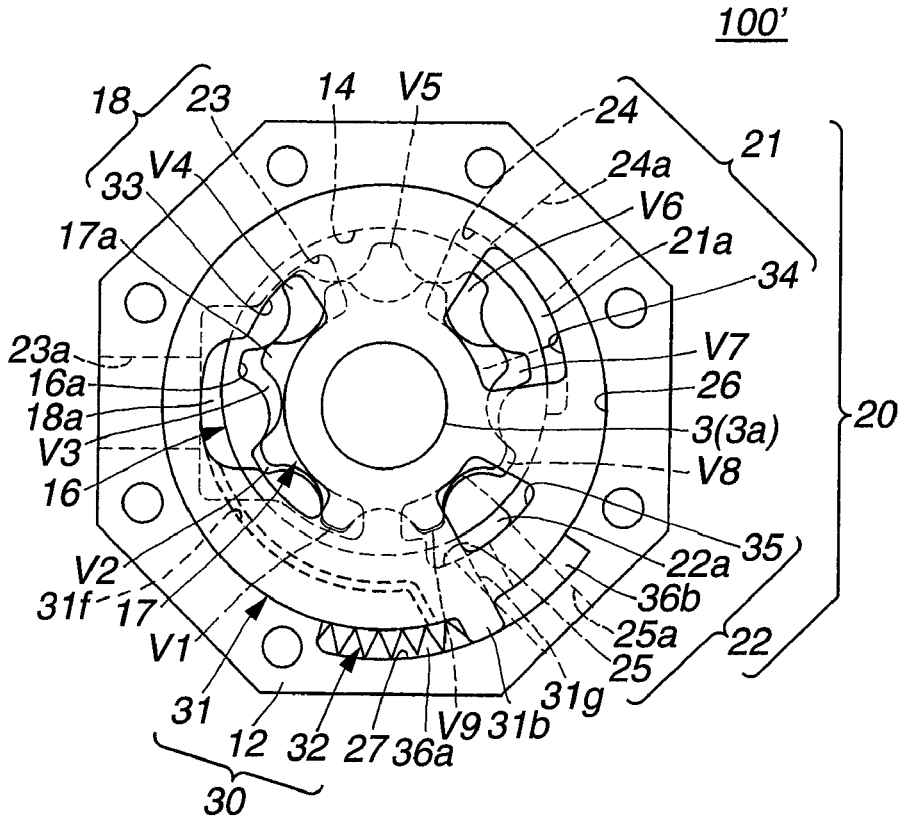
FIG. 10 is a table showing a hydraulic pressure and a fluid introducing rate that are needed by each hydraulic circuit under various operation conditions.
FIG. 11 is a view similar to FIG. 1, but showing a modification of the oil pump of the first embodiment.

In the following, operation of oil pump 100 practically set in an actual hydraulic circuit will be described with reference to FIGS. 7 and 10. That is, as is seen from FIG. 7, under operation, oil pump 100 feeds the hydraulic fluid to both constant pressure circuit 5 and high pressure circuit 6.

For operating constant pressure circuit 5, the following facts are to be considered. That is, for lubricating and cooling the elements of the engine and transmission (viz., elements benefiting from constant pressure circuit 5), constant pressure circuit 5 needs a relatively low pressurized (viz., pressure P1) and constantly stable hydraulic fluid. However, as is known to those skilled in the art, clearances between mutually contacting portions of the elements are varied in accordance with rotation speed of the engine, and thus, the amount of hydraulic fluid needed for keeping the pressure P1 is varied in accordance with the rotation speed of the engine.

While, for operating high pressure circuit 6, the following facts are to be considered. When the actuator of the variable valve timing mechanism of the engine and the actuators of the hydraulic clutches and hydraulic brakes of the transmission are at rest, it is only necessary to feed the high pressure circuit 6 with a hydraulic fluid of low pressure (P2). That is, only when such actuators are in operation, it becomes necessary to feed the circuit 6 with a hydraulic fluid of high pressure (P3).

Thus, in the present invention, as is seen from FIG. 7, first outlet port 21 of oil pump 100 is connected to constant pressure circuit 5 through pipe 24*a*. That is, by the rotation of rotary plate 31 in accordance with the discharge pressure in first outlet port 21, the fluid discharge rate of first outlet port 21 or second outlet port 22 is varied keeping the discharge pressure in first outlet port 21 at the relatively low predetermined pressure P1.

As is seen from FIG. 7, second outlet port 22 is connected to high pressure circuit 6. Thus, the discharge pressure in second outlet port 22 is detected by pressure sensor 7 and an information signal on the detected discharge pressure is fed to the electronic control unit 2. That is, when the above-mentioned actuators are at rest, control unit 2 controls the rotation speed of electric motor 3 (viz., oil pump 100) to keep the discharge pressure in second outlet port 22 to the low level P2, while when the actuators are in operation, control unit 2 controls the rotation speed of electric motor 3 to keep the discharge pressure in second outlet port 22 to the high level P3.

In a low speed operation condition wherein the engine rotation speed is low, constant pressure circuit 5 needs a relatively small amount (Q1) of hydraulic fluid of the predetermined pressure P1, and high pressure circuit 6 needs a small amount (Q3) of hydraulic fluid of the predetermined low pressure P2.

While, in a normal operation condition wherein the engine rotation speed is higher than that of the above-mentioned low speed operation condition, constant pressure circuit 5 needs a relatively larger amount (Q2) of hydraulic fluid of the predetermined pressure P1, and high pressure circuit 6 needs a smaller amount (Q3) of hydraulic fluid of the predetermined low pressure P2. While, upon operation of the actuators, high pressure circuit 6 needs a much larger amount (Q4) of hydraulic fluid of the predetermined pressure P3.

In view of the above description, the following inequalities are established.

In hydraulic pressure:

$$P3>P1\geqq P2 \quad (1)$$

In fluid amount:

$$Q4>Q2>Q1\geqq Q3 \quad (2)$$

As will be understood from the above description, each of constant pressure circuit 5 and high pressure circuit 6 is subjected to a marked fluctuation in both hydraulic pressure and fluid amount in accordance with the engine operation condition. Particularly in fluid amount, the general fluid discharge rate of oil pump 100 and the fluid discharge rate of each of the two outlet ports 21 and 22 of the pump 100 is subjected to a marked change.

In the following, operation of oil pump 100 itself will be described concretely with reference to the drawings.

When oil pump 100 is at rest, the open degree of first outlet port 21 shows the maximum value as is mentioned hereinabove.

When, upon starting of the engine, oil pump 100 starts its operation and comes into the low speed operating condition, rotary plate 31 is rotated in a counterclockwise direction in FIG. 1 to reduce the open degree of first outlet port 21, so that the discharge pressure of first outlet port 21 shows the predetermined pressure P1.

When now pressure sensor 7 senses that the hydraulic pressure applied to high pressure circuit 6 is higher than the low predetermined level P2, control unit 2 reduces the rotation speed of electric motor 3, and when the sensor 7 senses that the pressure applied to high pressure circuit 6 is lower than the low predetermined level P2, control unit 2 increases the rotation speed of electric motor 3. That is, in accordance with the hydraulic pressure in high pressure circuit 6, control unit 2 controls electric motor 3.

When the rotation speed of electric motor 3 is reduced, the rotation speed of oil pump 100 is accordingly reduced and thus the hydraulic pressure in first outlet port 21 is reduced. Accordingly, by rotating rotary plate 31 to a desired angular position, the fluid discharge rate of first outlet port 21 is increased keeping the discharge pressure in first outlet port 21 at the predetermined level P1.

While, when the rotation speed of electric motor 3 is increased, the rotation speed of oil pump 100 is increased and thus the hydraulic pressure in first outlet port 21 is increased. Accordingly, by rotating rotary plate 31 to a desired angular position, the fluid discharge rate of first outlet port 21 is reduced keeping the discharge pressure in first outlet port 21 at the predetermined level P1.

Due to the change of rotation speed of electric motor 3 and the change of the fluid discharge rate of first outlet port 1, the hydraulic pressure in high pressure circuit 6 is subjected to a change. Thus, by processing a feedback signal, control unit 2 controls electric motor 3 in a manner to keep the discharge pressure of second outlet port 22 at the lower level P2.

By turning rotary plate 31 and controlling the rotation speed of electric motor 3 in the above-mentioned manner, each of control pressure circuit 5 and high pressure circuit 6 is fed with a desired amount Q1 or Q3 of the hydraulic fluid of the predetermined pressure P1 or P2.

When then the engine shifts from the low speed operation condition to the normal operation condition, the amount of hydraulic fluid fed to constant pressure circuit 5 changes from Q1 to Q2. The hydraulic pressure of the fluid fed to this circuit 5 is not changed. While, upon such change, the amount of hydraulic fluid and pressure fed to high pressure circuit 6 do not change.

That, if the amount of hydraulic fluid led to constant pressure circuit 5 is lower than the level Q2, the hydraulic pressure appearing in first outlet port 21 lowers. Thus, for keeping the hydraulic pressure in constant pressure circuit 5 at the predetermined level P1, rotary plate 31 is turned to an angular position to increase the fluid discharge rate of first outlet port 21. That is, in such case, the hydraulic pressure in constant pressure circuit 5 is increased to the predetermined level P1.

In response to the increase of the fluid discharge rate of first outlet port 21, the fluid discharge rate of second outlet port 22 tends to be decreased. Thus, if the discharge pressure at second outlet port 22 does not reach the low level P2 that is needed by high pressure circuit 6, control unit 2 controls electric motor 3 to increase the rotation speed of the same.

When, due to increase of the rotation speed of electric motor 3, the rotation speed of oil pump 100 is increased, the change in pressure of the hydraulic fluid fed to constant pressure circuit 5 affects or controls the fluid discharge rate of each of first and second outlet ports 21 and 22. Thus, the change in pressure of the hydraulic fluid fed to high pressure circuit 5 affects or controls the rotation speed of electric motor 3.

Thus, like in the above-mentioned low speed operation condition, each of constant pressure circuit 5 and high pressure circuit 6 is fed with a desired amount Q2 or Q3 of the hydraulic fluid of the predetermined pressure P1 or P2.

In order to operate the actuators employed in the engine and transmission, it is necessary to feed high pressure circuit 6 with a large amount of highly pressurized hydraulic fluid. Accordingly, control unit 2 controls or increases the rotation speed of electric motor 3 until the time when the hydraulic pressure in the circuit 6 is increased to the level P3.

While, under such condition, constant pressure circuit 5 does not need the increase of hydraulic pressure and fluid amount. That is, since the increase in fluid discharge rate of first outlet port 21 caused by the increase of rotation speed of oil pump 100 induces an excessive fluid discharge pressure, rotary plate 31 is rotated in a counterclockwise direction in the drawing to reduce the fluid discharge rate of first outlet port 21 thereby to keep the hydraulic pressure at the level P1.

In second outlet port 22, the hydraulic pressure and hydraulic fluid are increased due to increase of rotation speed of oil pump 100 and increase of fluid discharge rate. That is, control unit 2 controls or increases the electric motor 3 until the time when the hydraulic fluid fed to high pressure circuit 6 shows a target amount Q4 and the hydraulic pressure P3.

Accordingly, when the rotation speed of oil pump 100 is increased, only the fluid discharge rate of second outlet port 22 can be increased without increase in the fluid discharge rate of first outlet port 21. Thus, each of constant pressure circuit 5 and high pressure circuit 6 is fed with a desired amount Q1 or Q3 of the hydraulic fluid of the predetermined pressure P1 or P2.

As is described hereinabove, the hydraulic pressure in constant pressure circuit 5 affects or controls the fluid discharge rate of first outlet port 21 and that of second outlet port 22, and the hydraulic pressure in high pressure circuit 6 affects or controls the rotation speed of electric motor 3, so that the general discharge rate of oil pump 100 is controlled. Thus, each pressure circuit 5 or 6 is fed with a desired amount of hydraulic fluid of desired pressure.

In the first embodiment, rotary plate 31 is rotatably mounted to pump housing 11. First and second outlet ports 21 and 22 are provided by a unit that consists of rotary plate 31 and pump housing 11. First outlet port 21 comprises first fixed outlet port 24 defined by pump body 12 and first movable outlet port 34 defined by rotary plate 31, and second outlet port 22 comprises second fixed outlet port 25 defined by pump body 12 and second movable outlet port 35 defined by rotary plate 31. Accordingly, by rotating rotary plate 31, the circumferential open range of first outlet port 21 exposed to pump chambers V6 and V7 and that of second outlet port 22 exposed to pump chambers V8 and V9 are varied, and thus, the fluid discharge rate of first and second outlet port 21 and 22 is variable.

Accordingly, constant pressure circuit 5 and high pressure circuit 6 that are respectively connected to first and second outlet ports 21 and 22 enjoy the variable fluid discharge rate separately. In other words, elements of the engine and transmission benefiting from constant pressure circuit 5 and elements of the engine and transmission benefiting from high pressure circuit 6 are supplied with a sufficient amount of hydraulic fluid from oil pump 100 without forcing electric motor 3 to do excessive work. This brings about a compact construction of electric motor 3 and energy saving of a motor vehicle that employs the oil pump 100.

Referring to FIGS. 11 to 14, there is shown a modification 100' of oil pump 100 of the above-mentioned first embodiment.

Figure 12:
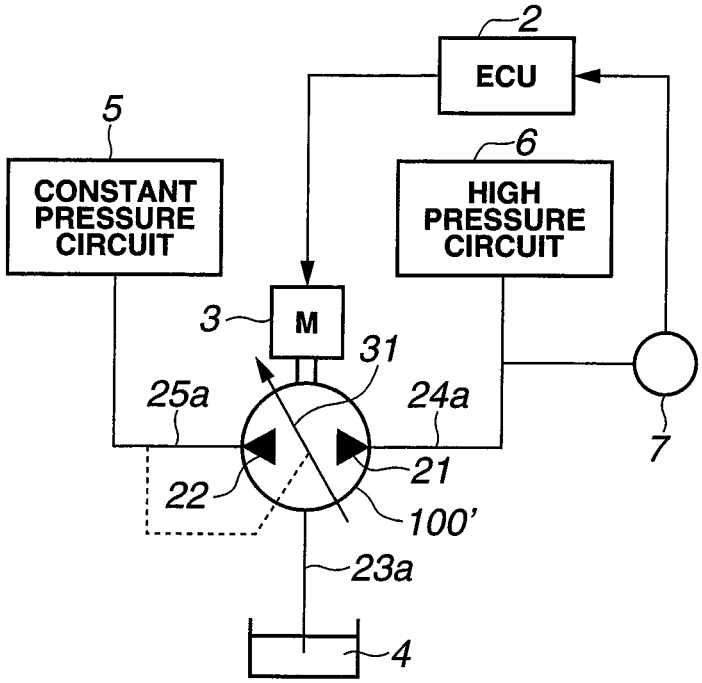
FIG. 12 is a hydraulic circuit to which the modification of the oil pump of the first embodiment is practically applied.
Figure 13:
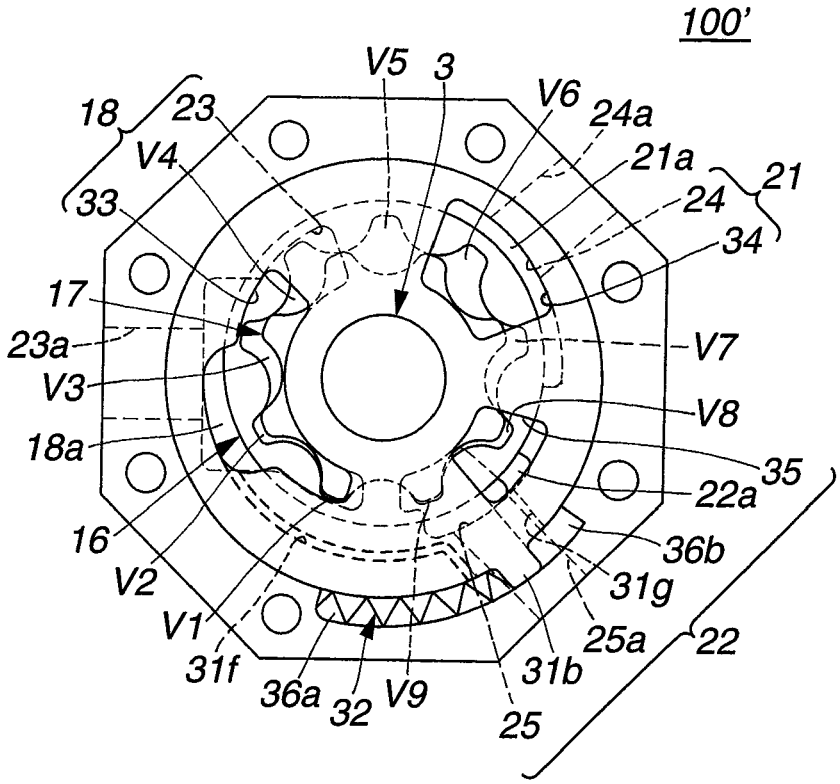
FIG. 13 is a view similar to FIG. 11, but showing a condition in which a discharging pressure of a first outlet port is lower than a predetermined value (viz., initial condition of the oil pump)
Figure 14:
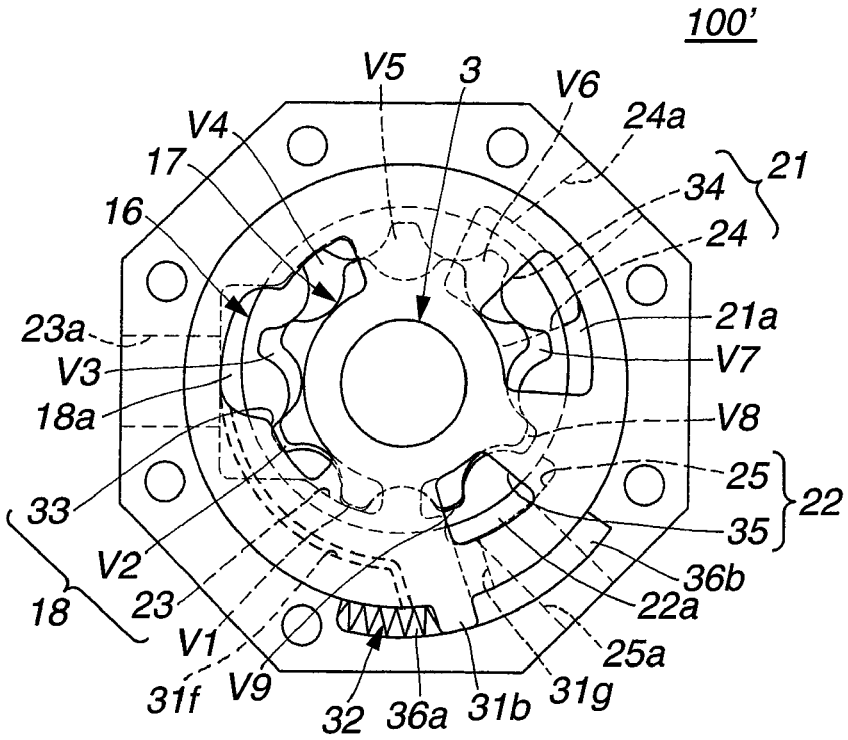
FIG. 14 is a view similar to FIG. 11, but showing a condition in which the discharging pressure of the first outlet port shows a maximum value.

As is seen from FIG. 12, in this modification 100', unlike the first embodiment 100, first outlet port 21 is connected to high pressure circuit 6 and second outlet port 22 is connected to constant pressure circuit 5. Furthermore, rotary plate 31 is rotated by the discharge pressure appearing in second outlet port 22.

Because of similar construction, modification 100' enjoys substantially same advantages as those possessed by the above-mentioned first embodiment 100.

Referring to FIGS. 15 to 22, there is shown an oil pump 200 which is a second embodiment of the present invention.

Since this second embodiment 200 is similar in construction to the above-mentioned first embodiment 100, only portions or parts that are different from those of the first embodiment 100 will be described in the following.

Figure 15:
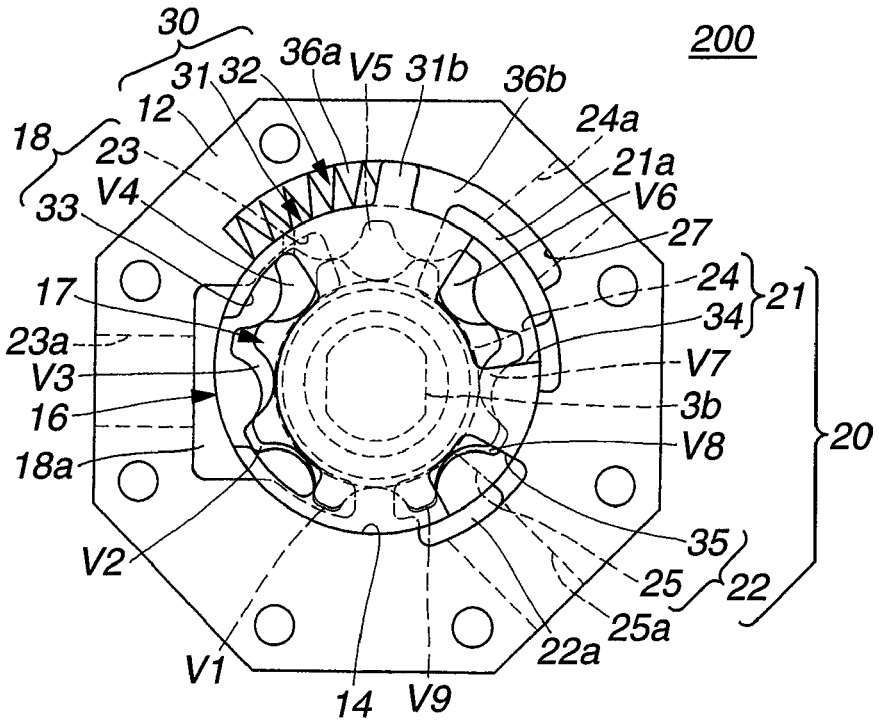
FIG. 15 is a view similar to FIG. 1, but showing an oil pump of a second embodiment of the present invention, showing a mating surface of a pump body.
Figure 19:
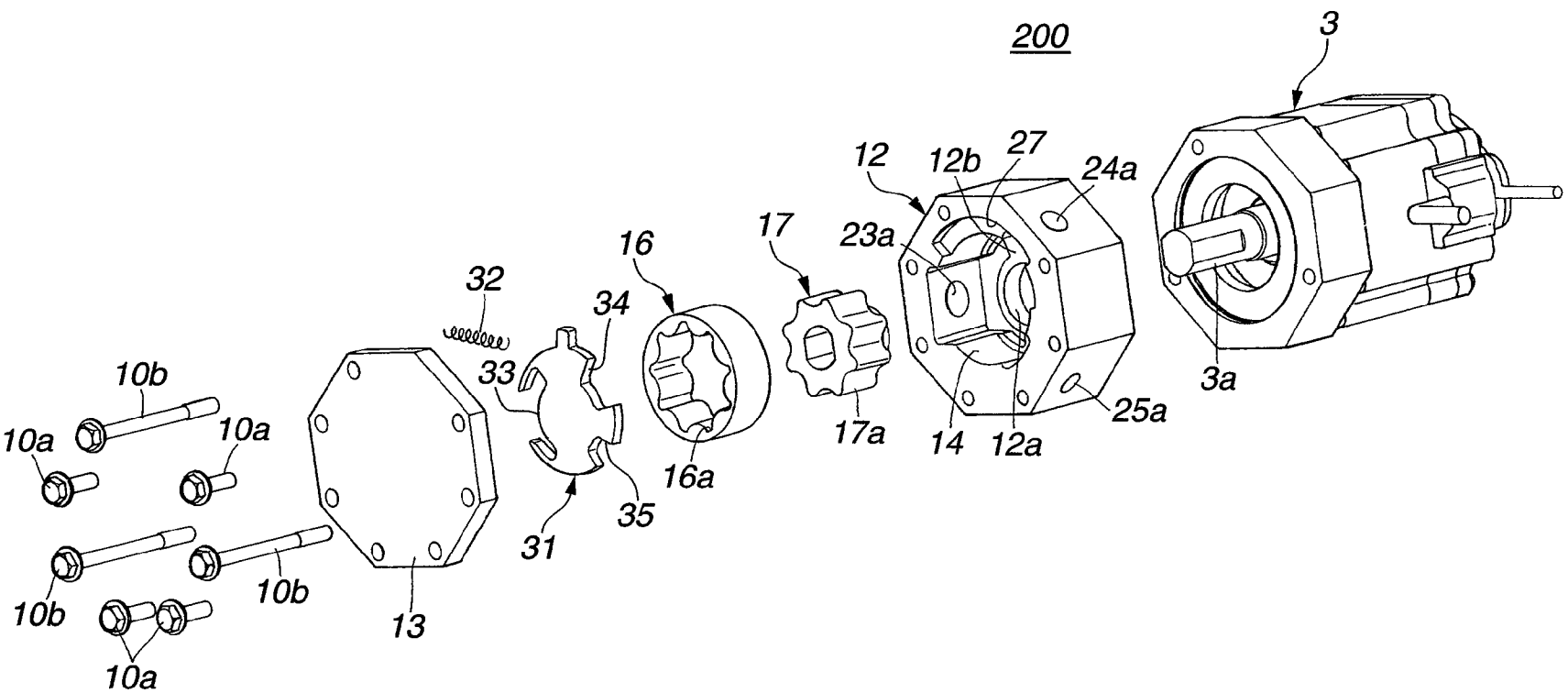
FIG. 19 is an exploded perspective view of the oil pump of the second embodiment.
Figure 20:
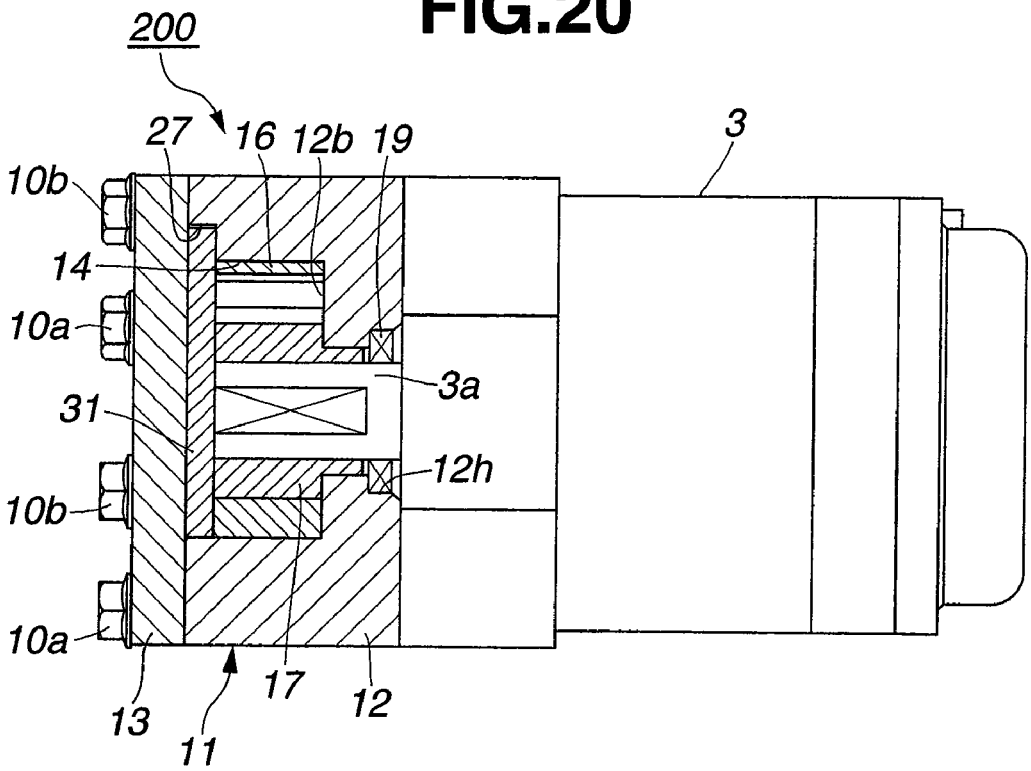
FIG. 20 is a partially sectioned side view of a unit including the oil pump of the second embodiment and an electric motor, showing the oil pump in a sectional manner.
Figure 21:
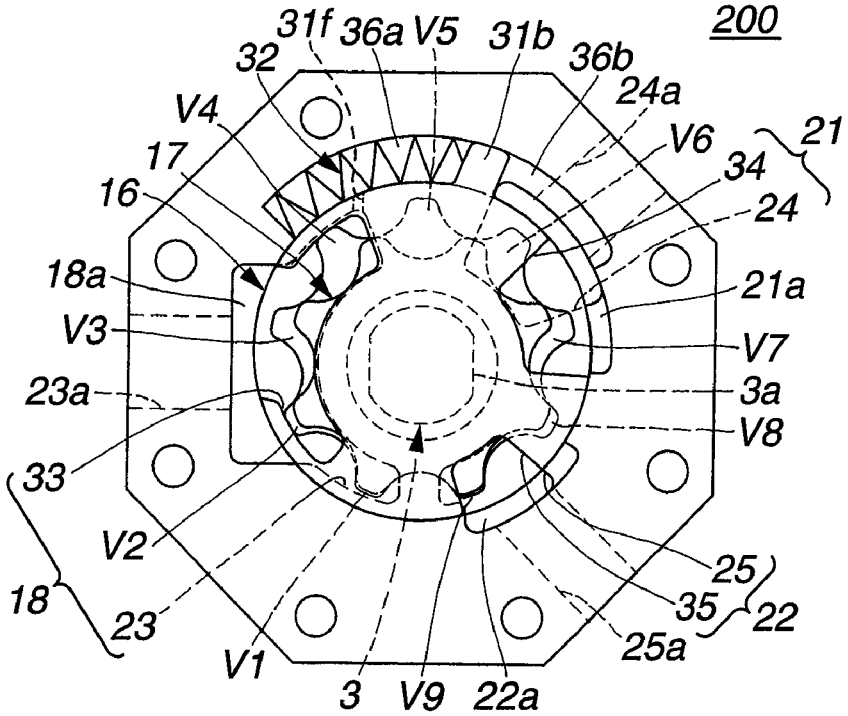
FIG. 21 is a view similar to FIG. 15, but showing a condition in which a discharging pressure of a first outlet port is lower than a predetermined value (viz., initial condition of the oil pump)
Figure 22:
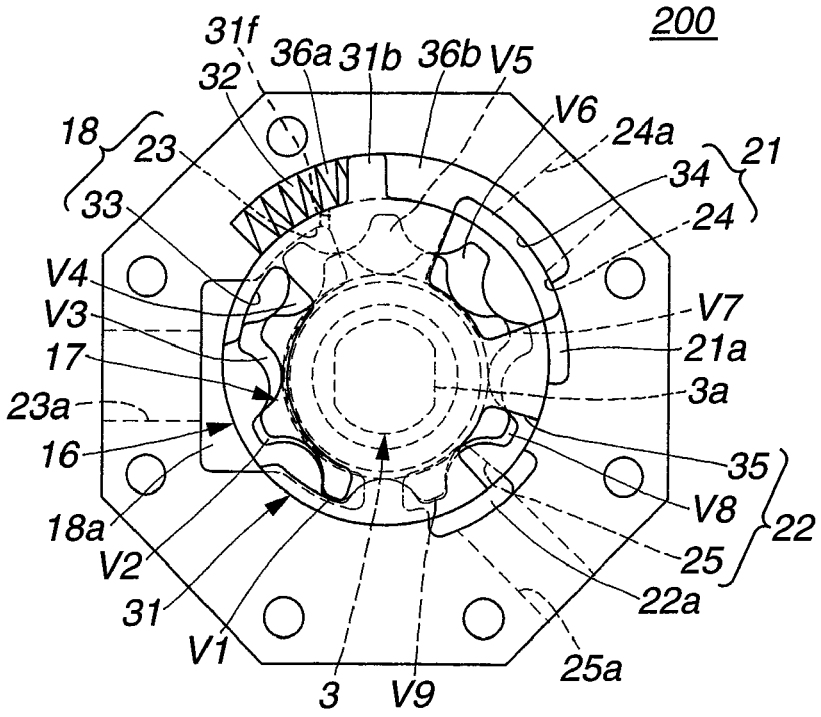
FIG. 22 is a view similar to FIG. 15, but showing a condition in which the discharging pressure of the first outlet port shows a maximum value.

That is, as is seen from FIGS. 15, 19 and 20, oil pump 200 has no drive shaft like the drive shaft 15 used in the first embodiment 100. That is, in the second embodiment 200, inner rotor 17 is directly connected to output shaft 3*a* of electric motor 3. Cover member 13 has no bore like the bearing blind bore 13*a* used in the first embodiment 100. That is, output shaft 3*a* is rotatably held by only bearing bore 12*a* of pump body 12.

More specifically, in oil pump 200 of the second embodiment, inner rotor 17 is fixed to a leading end of output shaft 3*a* with across flat. Unlike the first embodiment 100 in which drive shaft 15 passes through rotary plate 31, rotary plate 31 has no opening like the shaft receiving opening 31*a* employed in the first embodiment.

Figure 16:
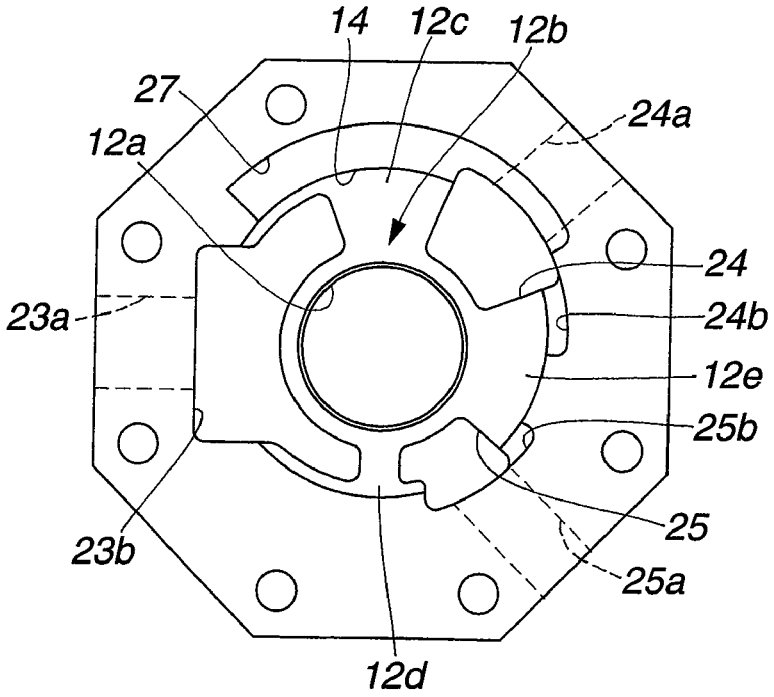
FIG. 16 a view similar to FIG. 15, but showing a condition in which various pump elements and a discharge rate varying mechanism are removed.
Figure 17:
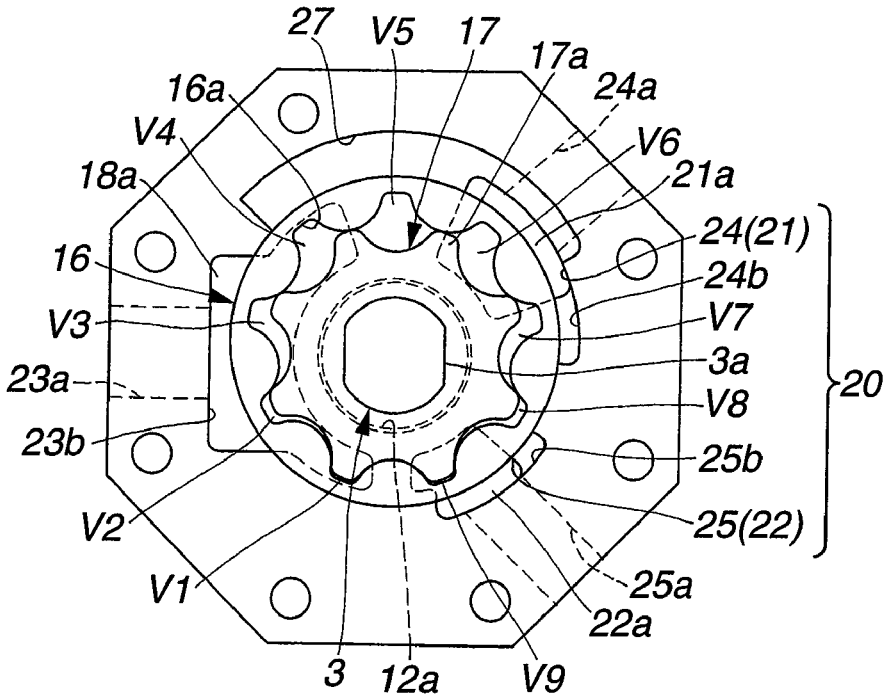
FIG. 17 is a view similar to FIG. 15, but showing a condition in which the discharge rate varying mechanism is removed.

As is seen from FIGS. 15 to 17, there is no need of providing pump body 12 with a recess for receiving rotary plate 31 that corresponds to the cylindrical recess 26 employed in first embodiment 100. That is, in the second embodiment 200, rotary plate 31 is received in rotor receiving bore 14 together with outer rotor 16.

As is seen from FIG. 15, rotary plate 31 is sized to have the generally same diameter as outer rotor 16. Thus, movable inlet port 33 and first and second movable outlet ports 34 and 35 of rotary plate 31 are each shaped like a recess provided at the periphery of rotary plate 31.

Figure 18:
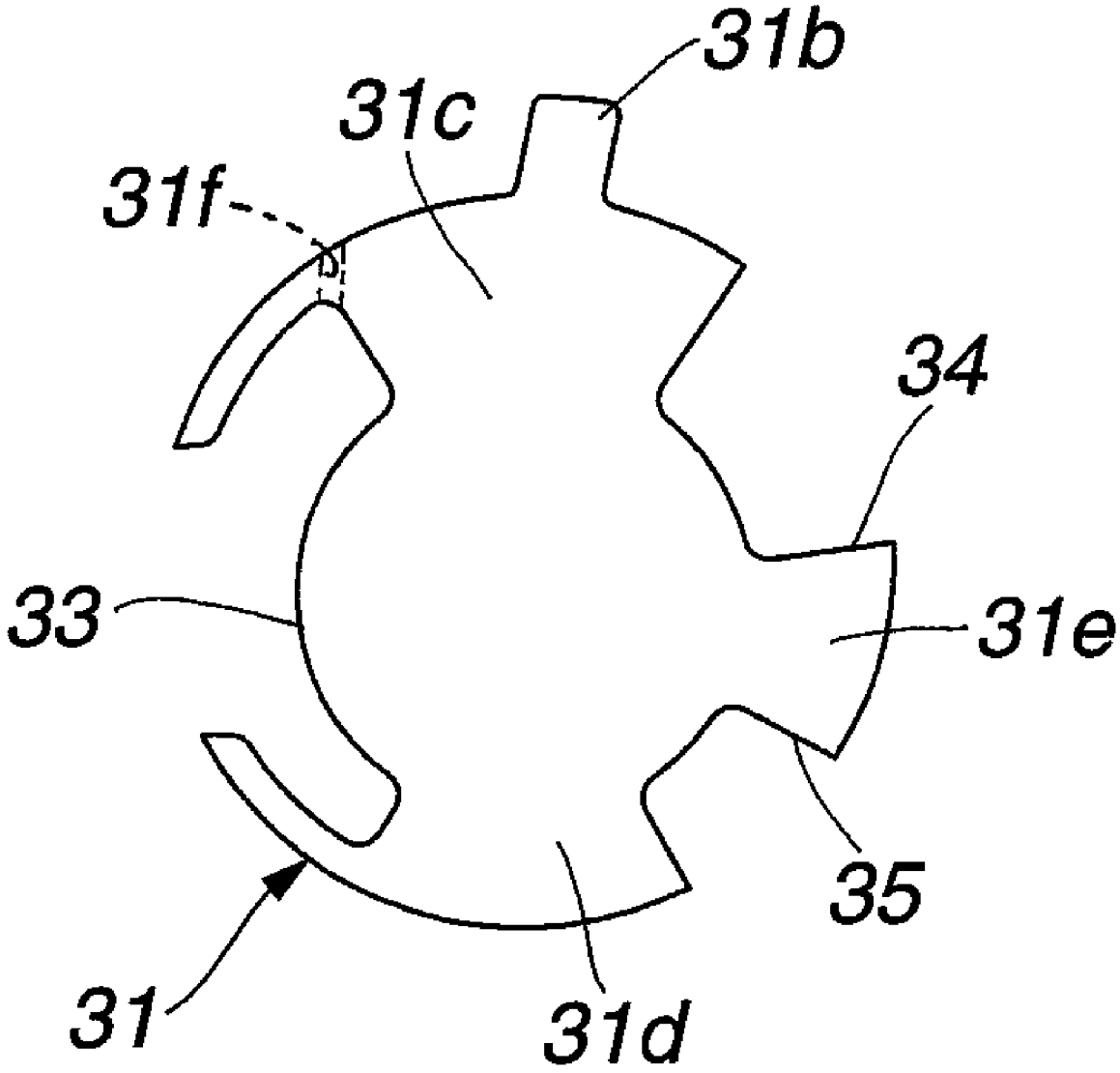
FIG. 18 is a front view of a rotary plate employed in the oil pump of the second embodiment of the present invention.

That is, as is seen from FIG. 18, rotary plate 31 employed in this second embodiment 200 has no annular rim portion.

That is, unlike in first embodiment 100, movable inlet port 33 and first and second movable outlet ports 34 and 35 of rotary plate 31 are recesses, not enclosed openings (see FIG. 4).

It is to be noted that also in second embodiment 200, first outlet port 21 is connected to constant pressure circuit 5 and second outlet port 22 is connected to high pressure circuit 6.

Accordingly, in this second embodiment 200, substantially same advantageous operation as in the first embodiment 100 is carried out. Furthermore, since in the second embodiment 200 rotary plate 31 and outer rotor 16 are received in the common rotor receiving bore 14, production of pump body 12 is easily achieved as compared with pump body 12 used in the first embodiment 100. That is, in the first embodiment 100, cylindrical recess 26 is provided by pump body 12 in addition to rotor receiving bore 14. As is known, easy production brings about reduction in cost of oil pump 200.

Referring to FIGS. 23 to 29, there is shown an oil pump 300 which is a third embodiment of the present invention.

Since this third embodiment 300 is similar in construction to the above-mentioned first embodiment 100, only portions or parts that are different from those of the first embodiment 100 will be described in the following.

Figure 23:
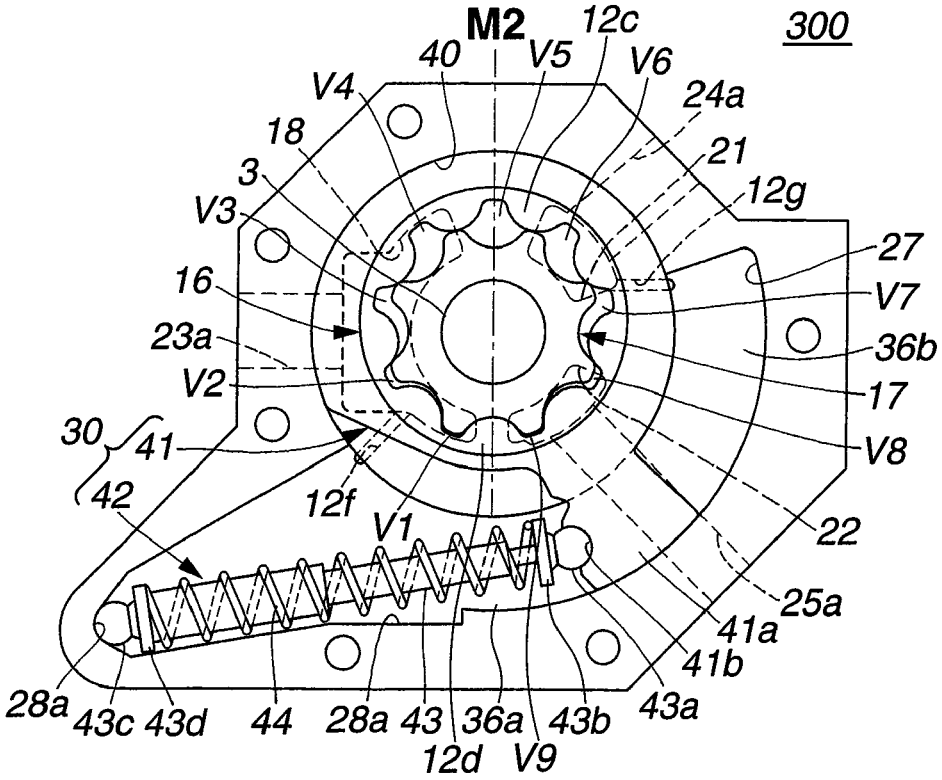
FIG. 23 is a view similar to FIG. 1, but showing an oil pump of a third embodiment of the present invention, showing mating surface of a pump body.
Figure 26:
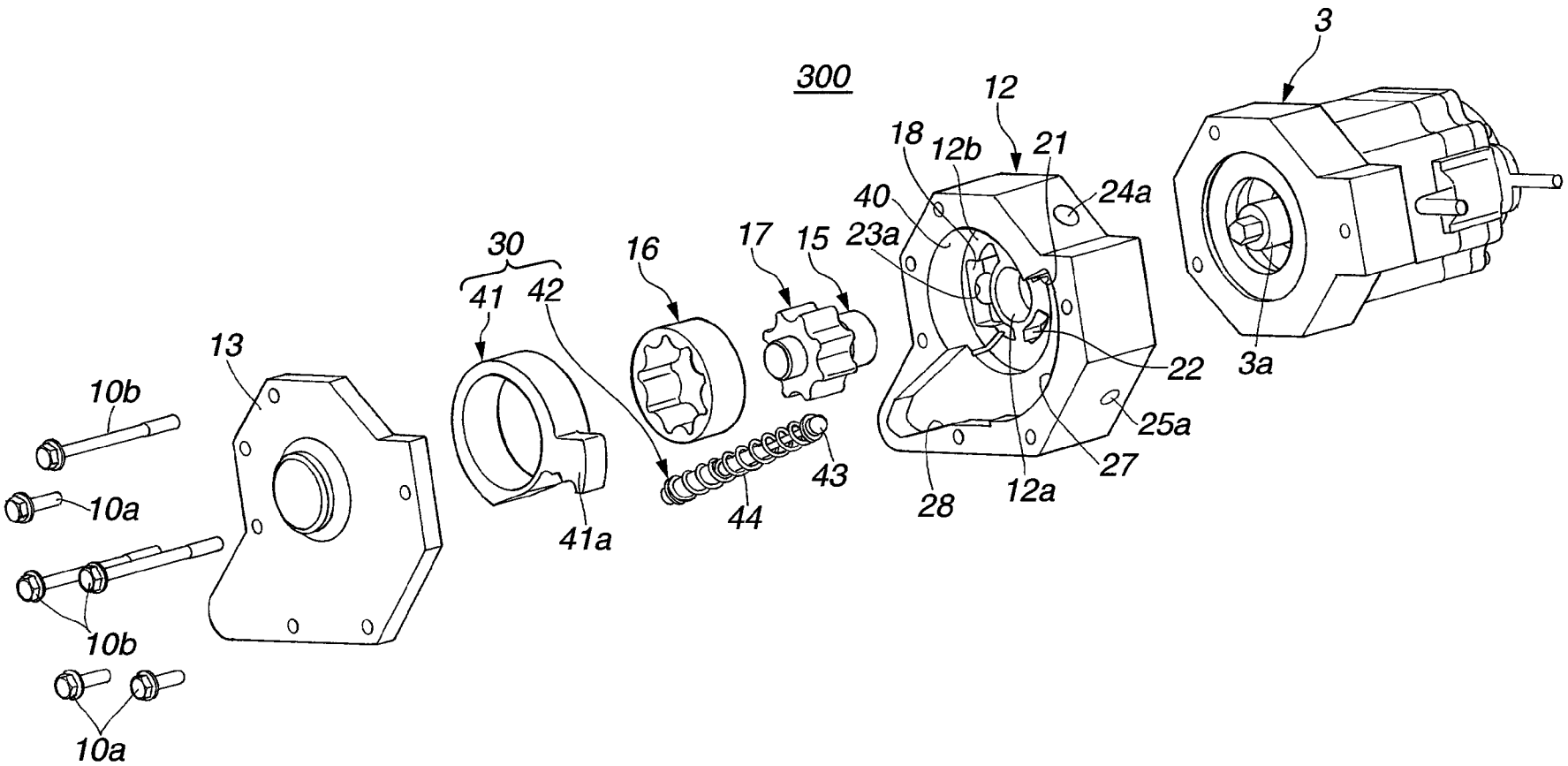
FIG. 26 is an exploded perspective view of the oil pump of the third embodiment.
Figure 27:
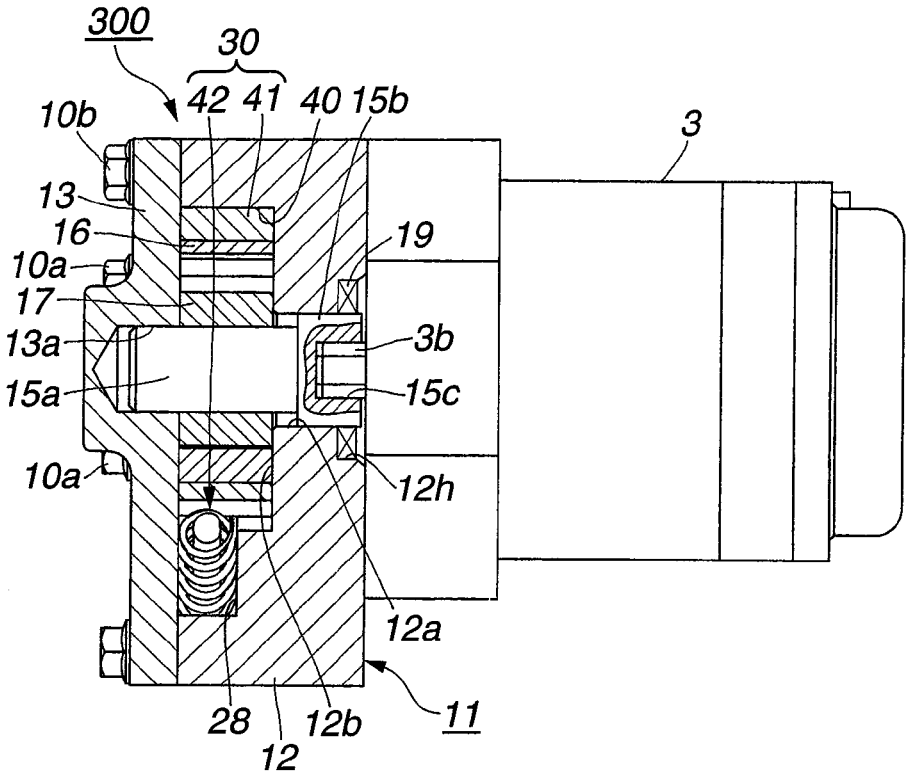
FIG. 27 is a partially sectioned side view of a unit including the oil pump of the third embodiment and an electric motor, showing the oil pump in a sectional manner.

As is seen from FIGS. 23, 26 and 27, pump body 12 has a shape different from that of first embodiment 100. That is, as is seen from FIG. 26, pump body 12 is shaped to have a triangular projection.

As is best understood from FIG. 26, pump body 12 has a generally cylindrical pump element receiving bore 40 that is coaxial with the bearing bore 12*a* formed in one end wall thereof.

The depth of the receiving bore 40 is substantially the same as the thickness of outer and inner rotors 16 and 17.

Within the receiving bore 40, there is rotatably received a rotary ring 41 that constitutes part of an after-mentioned discharge rate varying mechanism 30.

Rotary ring 41 comprises outer and inner cylindrical walls (no numerals) that are eccentric to each other. Rotary ring 41 is formed with a lever portion 41*a*.

Within rotary ring 41, there is operatively received a unit of outer and inner rotors 16 and 17 in substantially the same manner as in case of the first embodiment 100. In this third embodiment 300, inner rotor 17 is provided with drive shaft 15 that is connected to output shaft 3*a* of electric motor 3.

As is seen from FIG. 26, on the inner surface of an axial wall portion of pump body 12, there is defined a rotor sliding surface 12*b* to which one axial end surface of each rotor 16 or 17 slidably contacts under rotation of the rotors 16 and 17.

Figure 24:
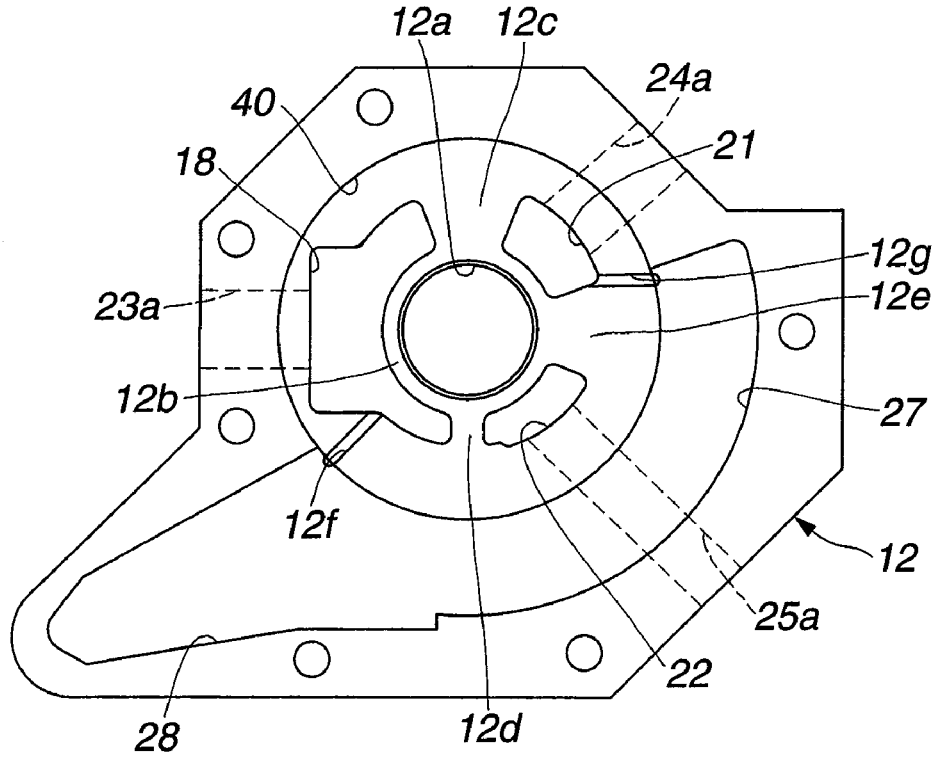
FIG. 24 is a view similar to FIG. 23, but showing a condition in which various pump elements and a discharge rate varying mechanism are removed.
Figure 25:
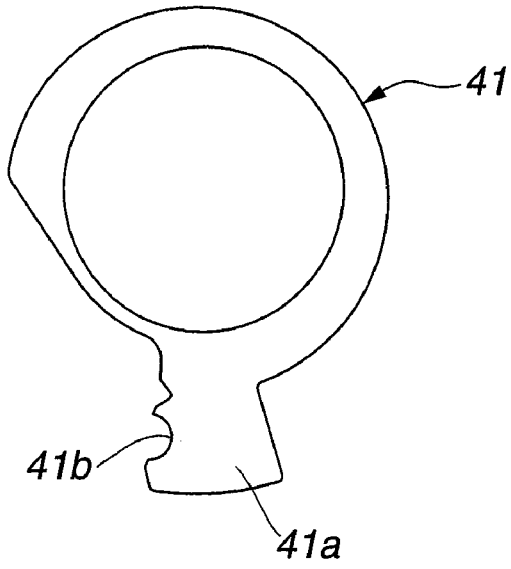
FIG. 25 is a front view of a rotary ring (or rotary plate) employed in the oil pump of the third embodiment.

As is best shown in FIG. 24, rotor sliding surface 12*b* is formed with inlet port 18 and first and second outlet ports 21 and 22 around bearing bore 12*a*. As shown, these ports 18, 21 and 22 are similar to the fixed ports 23, 24 and 25 (see FIG. 2) provided by oil pump 100 of the first embodiment.

As is seen from FIG. 26, rotary ring 41 is a member corresponding to the above-mentioned rotary plate 31 employed in the first embodiment 100. However, rotary ring 41 has no openings corresponding to movable and fixed ports 33, 34 and 35 as shown.

As is seen from FIG. 24, first, second and third seal lands 12*c*, 12*d* and 12*e* are defined on rotor sliding surface 12*b* like in case of the first embodiment 100. First and third seal lands 12*c* and 12*e* have each a circumferential length that is generally the same as the pitch of external teeth 17*a* of inner rotor 17, and second seal land 12*d* has a circumferential length that is generally the same as the distance between adjacent two bottoms of the internal teeth 16 of outer rotor 16.

As is seen from FIGS. 24 and 26, cylindrical recess 40 is formed at a cylindrical wall thereof with an arcuate groove 27 that is depressed in radially outward. As shown, arcuate groove 27 extends from the position of third seal land 12*e* to the position of second seal land 12*d* in a direction of rotation of the rotors 16 and 17.

As is seen from FIG. 24, arcuate groove 27 has an extension 28 that extends in a tangential direction. Rotor sliding surface 12*b* of pump body 12 is further formed with a pressure relief groove 12*f* that extends from inlet port 18 to the extension 28 of arcuate groove 27 and a pressure induction groove 12*g* that extends from first outlet port 21 to arcuate groove 27.

As is understood from FIGS. 23 and 26, around outer rotor 16, there is arranged discharge rate varying mechanism 30 that functions to change a meshing position where internal teeth 16*a* of outer rotor 16 and external teeth 17*a* of inner rotor 17 are actually meshed. With such mechanism 30, the fluid discharge rate of each of first and second outlet ports 21 and 22 is continuously varied.

The discharge rate varying mechanism 30 generally comprises the above-mentioned rotary ring 41 that changes the meshing portion when rotated and an elongate biasing mechanism 42 that functions to bias rotary ring 41 in a given direction (viz., in a counterclockwise direction in FIG. 23) through lever portion 41*a* of rotary ring 41.

As is seen from FIG. 27, rotary ring 41 has the same thickness as the two rotors 16 and 17. As is mentioned hereinabove, rotary ring 41 comprises outer and inner cylindrical walls that are eccentric to each other. As shown, one axial end surface of rotary ring 41 slidably contacts the inner surface of cover member 13 and the other axial end surface of the ring 41 slidably contacts rotor sliding surface 12*b* of pump body 12.

Figure 28:
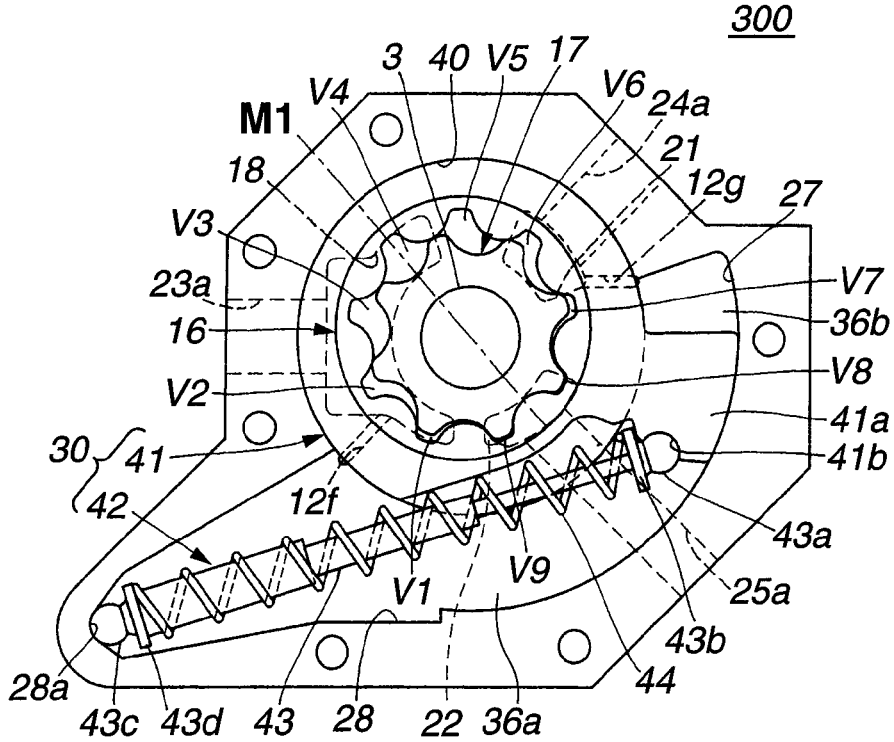
FIG. 28 is a view similar to FIG. 23, but showing a condition in which a discharging pressure of a first outlet port is lower than a predetermined value (viz., initial condition of the oil pump)

As is seen from FIG. 28, lever portion 41*a* of rotary ring 41 is movably placed in arcuate groove 27 of pump body 12. As shown, due to provision of lever portion 41*a*, arcuate groove 27 is divided into two chambers that are back pressure chamber 36*a* and pressure chamber 36*b*. As shown back pressure chamber 36*a* is placed in a trailing area with respect to the rotation direction of the two rotors 16 and 17 and contains therein elongate biasing mechanism 42, and pressure chamber 36 is placed in a leading area with respect to the rotation direction of the rotors 16 and 17 and communicated with first outlet port 21 through pressure induction groove 12*g*. The back pressure chamber 36*a* is communicated with inlet port 18 through pressure relief valve 12*f*.

Elongate biasing mechanism 42 comprises an elongate spring guide 43 that includes telescopically connected first, second and third pin members, spherical portions 43*a* and 43*c* that are formed on axially opposed ends of the spring guide 43, flanges 43*b* and 43*d* that are provided on the axially opposed ends within spherical portions 43*a* and 43*c* and a coil spring 44 that is disposed about spring guide 43 and compressed between the flanges 43*b* and 43*d* to bias spring guide 43 in a direction to expand the guide 43.

As shown in FIG. 28, one spherical portion 43*a* is pivotally received in a round cut 41*b* formed in the lever portion 41*a* of rotary ring 41, and the other spherical portion 43*c* is pivotally received in a round recess 28*a* formed in a leading end of the extension 28 of arcuate groove 27. Thus, due to the biasing force of biasing mechanism 42, rotary ring 41 is biased to rotate in a counterclockwise direction in FIG. 28.

In the following, with reference to FIGS. 23, 28 and 29, operation of oil pump 300 of the third embodiment will be described with respect to operation of discharge rate varying mechanism 30.

FIG. 28 shows a condition wherein oil pump 300 is about to start its pumping work. Under this condition, due to the biasing force of biasing mechanism 42, rotary ring 41 is biased in a counterclockwise direction (viz., in a direction opposite to the direction in which the two rotors 16 and 17 rotate) in the drawing and takes the counterclockwise-most position. Due to provision of stopper pins (not shown) provided by cover member 13, excessive counterclockwise rotation of rotary ring 41 is suppressed.

Under this condition, a relative eccentricity between outer and inner rotors 16 and 17 takes a mating line M1 with respect to which mutually meshed internal and external teeth 16*a* and 17*a* of the two rotors 16 and 17 are balanced, and the mating line M1 passes through a circumferential middle position of second outlet port 22. That is, under this condition, the pump chamber exposed to second outlet port 22 shows the minimum volume causing the fluid discharge rate of second outlet port 22 to be minimum (almost zero), and at the same time, the other pump chamber exposed to first outlet port 21 shows the maximum volume causing the fluid discharge rate of first outlet port 21 to be maximum. Since the mating line M1 is inclined relative to inlet port 18, the intake side pump chambers V1, V2, V3 and V4 take smaller open area relative to intake port 18, and thus, the total fluid discharge from oil pump 300 is restricted.

In response to increase of rotation speed of oil pump 300, the discharge pressure appearing at first discharge port 21 increases. When the discharge pressure exceeds a predetermined value (viz., set pressure), rotary ring 41 is forced to rotate clockwise to a position, such as the position as shown in FIG. 23, against the biasing force of spring 44.

In such position of FIG. 23, the relative eccentricity between outer and inner rotors 16 and 17 takes a mating line M2 with respect to which mutually meshed internal and external teeth 16*a* and 17*a* of the two rotors 16 and 17 are balanced, and the mating line M2 passes through respective circumferential middle positions of first and second seal lands 12*c* and 12*d*. That is, under this condition, an open degree of intake side pump cambers V1, V2, V3 and V4 to the ports 18, 21 and 22 and that of exhaust side pump chambers V6, V7, V8 and V9 to the ports 18, 21 and 22 are balanced, and thus, the total fluid discharge from oil pump 300 shows the maximum. That is, under such condition, each of first and second outlet ports 21 and 22 discharges the hydraulic fluid in the amount based on the angular position of third seal land 12*e*.

Figure 29:
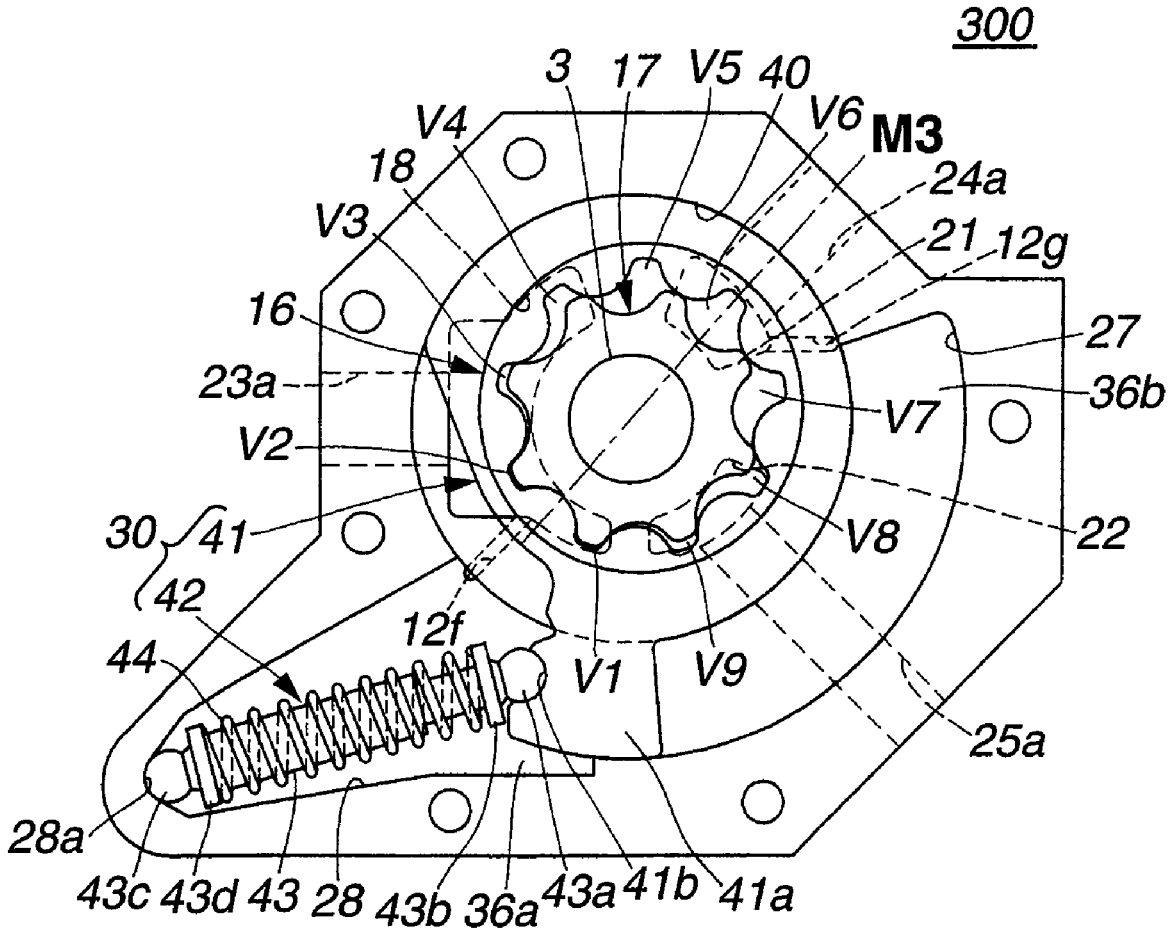
FIG. 29 is a view similar to FIG. 23, but showing a condition in which the discharging pressure of the first outlet port shows a maximum value.

When then the discharge pressure of first outlet port 21 further increases, rotary ring 41 is further turned in clockwise direction in FIG. 23 due to the force of the discharge pressure, and finally, rotary ring 41 takes the clockwise-most position of FIG. 29.

When rotary ring 41 is in such clockwise-most position, the relative eccentricity between outer and inner rotors 16 and 17 takes a mating line M3 with respect to which mutually meshed internal and external teeth 16*a* and 17*a* of the two rotors 16 and 17 are balanced, and the mating line M3 passes through a circumferential middle position of first outlet port 21. Under this condition, the pump chamber exposed to the circumferential middle portion of first outlet port 21 shows the maximum volume causing the fluid discharge rate of this first outlet port 21 to be minimum (almost zero), and at the same time, the other pump chamber exposed to second outlet port 22 shows the minimum volume causing the fluid discharge rate of this second outlet port 22 to be maximum. Since the mating line M3 is inclined relative to inlet port 18, the fluid intake rate of oil pump 300 is reduced and thus the total fluid discharge from oil pump 300 is restricted.

As is described hereinabove, in accordance with the discharge pressure of first outlet port 21 applied to lever portion 41*a*, rotary ring 41 is forced to rotate, and when the discharge pressure of first outlet port 21 is reduced, rotary ring 41 is rotated in a counterclockwise direction in FIG. 29 thereby to increase the fluid discharge rate from first outlet port 21.

In the discharge rate varying mechanism 30, rotary ring 41 is rotated in accordance with the discharge pressure appearing in first outlet port 21 thereby to continuously change the eccentric direction of each rotor 16 or 17.

With this, the fluid discharge rate of each of first and second outlet ports 21 and 22 is varied. Of course, the discharge distribution rate between first and second outlet ports 21 and 22 is continuously varied. By adjusting the discharge distribution rate, the discharge pressure of first outlet port 21 can be kept at a predetermined level (viz., set pressure).

As is described hereinabove, in the third embodiment 300, when one outlet port 21 or 22 exhibits the maximum discharge rate, the other outlet port 22 or 22 exhibits the minimum discharge rate. Accordingly, oil pumps 100, 200 and 300 can be selectively used in accordance with required characteristics of constant pressure and high pressure circuits 5 and 6.

In the foregoing description, discharge rate varying mechanism 30 is applied to oil pumps 100, 200 and 300 of a so-called trochoidal type. However, if desired, the mechanism 30 may be applied to other type oil pumps, which are for example, a variable displacement vane pump and the like.

In first and second embodiments 100 and 200, the circumferential position of third fixed side seal land 12*e* and that of third movable side seal land 31*e* may change in accordance with the user's needs. Also, in third embodiment 300, the circumferential position of third seal land 12*e* may change in accordance with such needs.

Furthermore, in embodiments 200 and 300, the connection of first and second outlet ports 21 and 22 to constant pressure circuit 5 and high pressure circuit 6 may be reversed like the circuit shown in FIG. 12. That is, in such case, rotary plate 31 or rotary ring 41 is rotated in accordance with the discharge pressure of second outlet port 22.

The entire contents of Japanese Patent Application 2008-24638 filed Feb. 5, 2008 are incorporated herein by reference.

Although the invention has been described above with reference to the embodiments of the invention, the invention is not limited to such embodiments as described above. Various modifications and variations of such embodiments may be carried out by those skilled in the art, in light of the above description.

What is claimed is:

1. An oil pump comprising:

a fluid inlet portion for introducing a hydraulic fluid;

a fluid outlet portion for discharging the hydraulic fluid, the fluid outlet portion including a plurality of outlet ports;

a drive shaft that rotates about an axis thereof;

a plurality of volume variable pump chambers arranged about the drive shaft and rotated by the same, the pump chambers being arranged between the fluid inlet portion and the fluid outlet portion for compressing the hydraulic fluid from the fluid inlet portion before discharging the same from the fluid outlet portion, the pump chambers being exposed to the outlet ports separately one after another when the pump chambers are rotated by the drive shaft; and a discharge rate varying mechanism that varies a fluid discharge rate of each of the outlet ports by varying the amount of the fluid led to the outlet ports;

wherein the fluid outlet portion comprises first and second outlet ports, wherein the discharge rate varying mechanism is constructed so that when the fluid discharge rate of the first outlet port is reduced, a discharge pressure of the first outlet port is reduced and at the same time the discharge pressure of the second outlet port is increased, wherein each of the outlet ports comprises one side outlet port part and the other side outlet port part which are respectively provided in paired defining members that define therebetween the pump chambers, the one side outlet port part and the other side outlet port part being communicated to each other, and wherein the discharge rate varying mechanism is so constructed as to make a relative movement between the paired defining members thereby to make a relative movement between the one side outlet port part and the other side outlet port part.

2. An oil pump as claimed in claim 1, wherein the first outlet port is connected to a constant pressure circuit that is constructed to lubricate and cool elements of an internal combustion engine with the hydraulic fluid, and the second outlet port is connected to a high pressure circuit that is constructed to provide hydraulically operated actuating devices of the engine with the hydraulic fluid to drive the same.

3. An oil pump as claimed in claim 1, wherein the drive shaft is driven by an electric motor.

4. An oil pump as claimed in claim 3, wherein the first outlet port is connected to a constant pressure circuit that is constructed to lubricate and cool elements of an internal combustion engine with the hydraulic fluid, the second outlet port is connected to a high pressure circuit that is constructed to provide hydraulically operated actuating devices of the engine with the hydraulic fluid to drive the same, and the electric motor is controlled to increase a rotation speed thereof when the hydraulically operated actuating devices are actually actuated.

5. An oil pump comprising:

a fluid inlet portion for introducing a hydraulic fluid;

a fluid outlet portion for discharging the hydraulic fluid, the fluid outlet portion including a plurality of outlet ports;

a drive shaft that rotates about an axis thereof;

a plurality of volume variable pump chambers arranged about the drive shaft and rotated by the same, the pump chambers being arranged between the fluid inlet portion and the fluid outlet portion for compressing the hydraulic fluid from the fluid inlet portion before discharging the same from the fluid outlet portion, the pump chambers being exposed to the outlet ports separately one after another when the pump chambers are rotated by the drive shaft, each outlet port extending in a circumferential direction around the axis of the drive shaft; and a discharge rate varying mechanism that varies an actual open range of each of the outlet ports relative to the pump chambers thereby to vary a fluid discharge rate of each outlet port;

wherein the fluid outlet portion comprises first and second outlet ports, wherein the discharge rate varying mechanism is constructed so that when the fluid discharge rate of the first outlet port is reduced, a discharge pressure of the first outlet port is reduced and at the same time the discharge pressure of the second outlet port is increased, wherein each of the outlet ports comprises one side outlet port part and the other side outlet port part which are respectively provided in paired defining members that define therebetween the pump chambers, the one side outlet port part and the other side outlet port part being communicated to each other, and wherein the discharge rate varying mechanism is so constructed as to make a relative movement between the paired defining members thereby to make a relative displacement between the one side outlet port part and the other side outlet port part.

6. An oil pump as claimed in claim 5, wherein the paired members are arranged to make the relative movement in accordance with a rotation speed of the drive shaft.

7. An oil pump as claimed in claim 5, wherein one of the paired members is a fixed member and the other of the paired members is a movable member that is movable relative to the fixed member.

8. An oil pump as claimed in claim 5, wherein the fluid outlet portion comprises two outlet ports, and wherein when the paired members make the relative movement, an actual open range of one of the outlet ports relative to the pump chambers is increased and at the same time the actual open range of the other of the outlet ports relative to the pump chambers is decreased.

9. An oil pump as claimed in claim 6, wherein the paired members are arranged to make the relative movement in accordance with a fluid discharge pressure appearing in one of the side outlet port parts of the outlet port.

10. An oil pump as claimed in claim 9, further comprising a biasing member that produces a biasing force against the relative movement of the paired members.

11. An oil pump as claimed in claim 8, wherein one of the paired members constitutes part of a pump housing that houses therein pump elements, and the other of the paired members constitutes a rotary plate that is rotatably and slidably put on axial ends of the pump elements at a position opposite to the other axial ends of the pump elements that rotatably and slidably contact a bottom of the pump housing.

12. An oil pump as claimed in claim 11, wherein the fluid inlet portion comprises one side inlet port part that is formed in the pump housing in a manner to be exposed to the pump chambers and the other side inlet port part that is formed in the rotary plate in a manner to be exposed to the pump chambers, and wherein a circumferential length of the one side inlet port part is equal to or greater than that of the other side inlet port part.

13. An oil pump comprising:

an inner rotor rotated by a drive shaft;

an outer rotor rotatably disposed around the inner rotor keeping an eccentricity relative to the inner rotor;

a plurality of volume variable pump chambers defined between the inner and outer rotors when the inner and outer rotors make a relative rotation;

a fluid inlet portion exposed to a circumferential range of the volume variable pump chambers that induces increase in volume of each pump chamber when the inner and outer rotors make the relative rotation;

a fluid outlet portion exposed to a circumferential range of the volume variable pump chambers that induces decrease in volume of each pump chamber when the inner and outer rotors make the relative rotation;

a discharge rate varying mechanism that varies a degree of the eccentricity of the outer rotor relative to the inner rotor; and a biasing mechanism that produces a biasing force against the rotation of the rotating member;

wherein the discharge rate varying mechanism comprises:

a rotating member that is rotatable about a rotation axis of the inner rotor and rotatably holds the outer rotor keeping the eccentricity of the outer rotor relative to the inner rotor, and a structure that varies a degree of eccentricity of the outer rotor relative to the inner rotor when the rotating member is rotated, and wherein the rotating member is rotated by a fluid discharge pressure appearing in one of output ports that constitute the fluid outlet portion.

14. An oil pump as claimed in claim 13, wherein the biasing mechanism comprises: a spring; and a guide member that guides expansion and contraction movement of the spring.

15. An oil pump as claimed in claim 14, further comprising a recess that is formed around the rotating member for receiving the biasing mechanism.

* * * * *